US005300418A

United States Patent [19]

Visconte et al.

[11] Patent Number: 5,300,418

[45] Date of Patent: Apr. 5, 1994

[54] VISCOSITY CONTROL OF PHOTOGRAPHIC MELTS

[75] Inventors: Gary W. Visconte, Rochester; Pranab Bagchi, Webster; James A. Friday; Michael W. Orem, both of Rochester, all of N.Y.; Alan R. Pitt, Hertfordshire, United Kingdom

[73] Assignee: Eastman Kodak Company, Rochester, N.Y.

[21] Appl. No.: 869,978

[22] Filed: Apr. 16, 1992

[51] Int. Cl.[5] ..... G03C 1/08

[52] U.S. Cl. ..... 430/546; 430/631; 430/637; 430/636; 430/634; 430/635; 430/639; 430/545; 430/222; 430/512; 430/563; 430/559; 252/126; 252/135

[58] Field of Search ..... 430/546, 631, 637, 636, 430/634, 635, 639, 545, 222, 512, 563, 559; 252/126, 135, 137

[56] References Cited

U.S. PATENT DOCUMENTS

| | | | |
|---|---|---|---|
| 2,240,469 | 4/1941 | Swan et al. | 430/631 |
| 3,050,394 | 8/1962 | Ezra et al. | 430/546 |
| 3,080,233 | 3/1963 | Roth et al. | 430/546 |
| 3,409,435 | 11/1968 | Seidel et al. | 430/637 |
| 3,514,293 | 5/1970 | Knox, Jr. | 430/632 |
| 3,516,830 | 6/1970 | Whiteley | 430/628 |
| 3,676,141 | 7/1972 | Hara et al. | 430/377 |
| 4,272,616 | 6/1981 | Kishimoto | 430/529 |
| 4,284,709 | 8/1981 | Tomka | 430/222 |
| 4,367,283 | 1/1983 | Nakayama et al. | 430/528 |
| 4,803,151 | 2/1989 | Steiger et al. | 430/546 |
| 4,917,993 | 4/1990 | Mukunoki et al. | 430/523 |
| 4,990,431 | 2/1991 | Bagchi et al. | 430/546 |
| 5,013,640 | 5/1991 | Bagchi et al. | 430/546 |
| 5,135,844 | 8/1992 | Bagchi et al. | 430/546 |

*Primary Examiner*—Charles L. Bowers, Jr.
*Assistant Examiner*—Thomas R. Neville
*Attorney, Agent, or Firm*—Paul A. Leipold

[57] ABSTRACT

The invention relates to a melt for the coating of a layer in a photographic element and which contains water, gelatin and an anionically charged, hydrophobic group containing compound that is (a) water soluble or soluble in a solution of 5 to 20 percent of water miscible organic solvent, said melt being further characterized by containing an amount of an amphiphilic compound which is sufficient to reduce the viscosity of said melt, said compound selected from the class consisting of:

Type A: Sugar (saccharidic) compounds, characterized by having one to three hydrophobic groups, each group containing from about 6 to about 22 carbon atoms, and having one or more attached hydrophilic mono- or oligosaccharidic hydrophilic chains that may or may not be terminated by a negatively charged group such as a sulfate, sulfonate or a carboxyl group; and Type B: Compounds compromising a hydrophobic group having from about 6 to about 22 carbon atoms and having one or two attached hydrophilic chains comprising at least 4 oxyethylene and/or glycidyl ether groups that may or may not be terminated with a negatively charged group such as a sulfate, sulfonate or a carboxy group.

and mixtures thereof

The preferred compounds for this invention are type A compounds.

29 Claims, 6 Drawing Sheets

VISCOSITY CONTROL OF PHOTOGRAPHIC MELTS

TECHNICAL FIELD

Certain photographic addenda which have large hydrophobic groups and also one or more anionic groups per molecule, produce significantly increased viscosity when added to gelatin-containing photographic melts. This invention relates to use of certain amphiphilic compounds to reduce viscosities of melts containing such addenda.

BACKGROUND ART

In conventional photographic coatings, emulsions, dispersions, and other photographic addenda for each speed or color separation layer are coated from fluid gelatin solutions, called melts or coating melts. Usually, coating takes place at temperatures between about 35° to about 50° C.

Generally, in the photographic art there are two primary methods of coating photographic materials. One is the bead coating process. U.S. Pat. No. 2,761,417—Russell et al, U.S. Pat. No. 2,681,294—Beguin, and U.S. Pat. No. 4,525,392—Ishizaki, illustrate simultaneously applying multiple layers of photographic materials by the bead coating process, and apparatus for practicing that process.

The second primary method is the curtain coating process. U.S. Pat. No. 3,632,374—Greiller, and U.S. Pat. No. 4,569,863—Koepke et al, illustrate apparatus and process for curtain coating.

It is well known that adjustment and control of viscosities of melts of individual layers can improve layer thickness uniformity of finished coated products. It is also known that layer viscosities outside optimum ranges may cause undesired variations in layer thickness during flow on the slides of the coating hopper or on a non horizontal web path after coating.

Certain photographic addenda such as masking couplers, oxidized developer scavengers, filter dyes, optical brighteners, ultraviolet radiation absorbers, dye transfer dyes, etc., when admixed in a melt comprising gelatin, produce excessively high viscosity, which leads to problems as described above. Such photographic addenda are in general molecules with large hydrophobic groups and are usually solubilized with one or more fully ionized anionic groups, such as $-SO_3^-$ (i.e., sulfonate) groups, sulfate groups or carboxy groups. Such materials are usually fully water soluble, or are soluble to the extent of about 5–20% by weight, in water containing 5 to 20% by weight of a water miscible auxiliary solvent such as methanol, ethanol, propanol, isopropanol, acetone, methyl ethyl ketone, ethyl acetate, or the like. Such materials behave also in a similar manner in the presence of gelatin.

It has been known from U.S. Pat. No. 3,409,435, that certain amphiphilic addenda, such as polyalkylene oxide block oligomers or polymers, when added to melts containing the mentioned viscosity-increasing photographic addenda, produce moderation of melt viscosity. Such amphiphilic addenda of the prior art (U.S. Pat. No. 3,409,435) can be defined as follows, and are illustrated by the representative structures of such compounds shown in Table I below:

Block oligomeric compounds comprising hydrophobic polyoxypropylene blocks (A) and hydrophilic polyoxyethylene blocks (B) joined in the manner of A-B-A, B-A-B, A-B, $(A\text{-}B)_n \equiv G \equiv (B\text{-}A)$, or $(B\text{-}A)_n \equiv G \equiv (A\text{-}B)$, where G is a connective organic moiety and n is between 1 and 3.

TABLE I

Representative Structures of Prior Art Amphiphilic Compounds Used in Melt Viscosity Control

| ID | Name (Manufacturer) | Best Known Structure | Molecular Weight Range |
|---|---|---|---|
| PA-1 | Pluronic TM Polyols (BASF)* | $HO-(CH_2CH_2-O)_a-(CH(CH_3)-CH_2-O)_b$ ┐ $H-(OCH_2-CH_2)_c$ ┘ <br> a = 1–128, b = 16–69, and c = 1–128 | 1,100 to 14,000 |
| PA-2 | Pluronic TM -R Polyols (BASF) | $HO-(CH(CH_3)-CH_2-O)_a-(CH_2-CH_2-O)_b$ ┐ $H-(O-CH_2-CH(CH_3))_c$ ┘ <br> a = 8–268, b = 43–204, and c = 8–268 | 1,900 to 9,000 |
| PA-3 | Plurodot TM Polyols (BASF)* | Liquid Polyethers Based on Alkoxylated Triols | 3,200 to 7,500 |

TABLE I-continued

| ID | Name (Manufacturer) | Representative Structures of Prior Art Amphiphilic Compounds Used in Melt Viscosity Control: Best Known Structure | Molecular Weight Range |
|---|---|---|---|
| PA-4 | Tetronic TM Polyols (BASF)* | 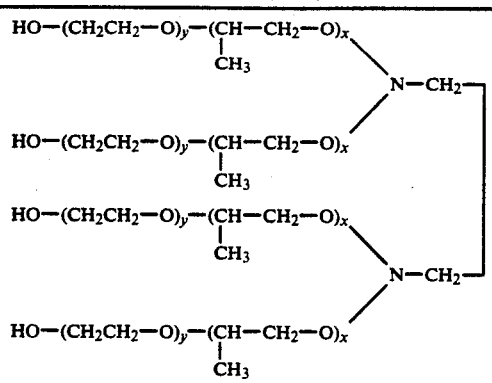 x = 2-31 and y = 7-491 | 3,200 to 27,000 |

*Pluronic L44 Polyol, a = c = 10; and b = 20.

Other examples of such amphiphilic addenda of prior art can be found in Ono et al. U.S. Pat. No. 3,860,425 (1975).

However, such prior art materials that contain a large number of polyalkylene oxide groups produce adverse photographic effects in some photographic products, as will be demonstrated in one of the examples set forth in this application.

One of the ways of reducing high viscosities of melts is by dilution with water. However, such a procedure leads to increased water load in the drier, under high speed coating conditions, used for high volume film and paper products. Therefore, dilution is not always a desirable approach.

Therefore, there is a need for melt compositions which will produce photographic melts (of the aforesaid photographic addenda and agents) which have sufficiently low viscosity, and adequate gelatin concentration, such that no excessive drier wet load is encountered during manufacturing of photographic paper and film products, and such that no, or substantially no, adverse effect is produced on the desired sensitometric behavior of the photographic multilayer pack in question.

DISCLOSURE OF INVENTION

An object of this invention is to reduce the high viscosity of photographic gelatin melts, which contains sulfonated, sulfated or carboxylated, substantially hydrophobic group containing photographic addenda that are water soluble, or rendered water soluble by assistance of a water miscible organic solvent. Another object is to produce a low viscosity coating melt having a sufficient gelatin concentration to produce an imperfection free or substantially imperfection free multilayer photographic film product which can be dried thoroughly at high coating speeds.

The invention is generally accomplished by providing a melt for the coating of a layer in a photographic element and which contains gelatin and an anionically charged, hydrophobic group containing compound that is (a) water soluble or rendered water soluble or rendered water soluble by solvent assistance, and (b) which confers an undesirably high viscosity to gelatin melts, said melt being further characterized by containing an amount of an amphiphilic compound which is sufficient to reduce the viscosity of said melt, of a compound selected from the class consisting of:

Type A: Sugar (saccharidic) compounds, characterized by having one to three hydrophobic groups, each group containing from about 6 to about 22 carbon atoms, and having one or more attached hydrophilic mono- or oligosaccharidic hydrophilic chains that may or may not be terminated by a negatively charged group such as a sulfate, sulfonate or a carboxyl group; and Type B: Compounds compromising a hydrophobic group having from about 6 to about 22 carbon atoms and having one or two attached hydrophilic chains comprising at least 4 oxyethylene and/or glycidyl ether groups that may or may not be terminated with a negatively charged group such as a sulfate, sulfonate or a carboxyl group The preferred amphiphilic compounds for this invention are type A compounds. The method for preparing the melt is also disclosed.

BRIEF DESCRIPTION OF THE DRAWINGS

In FIG. 5, the top curve, having points indicated with solid triangles, pertains to Example 2 (control). The curve in the middle, with points indicated by curves, pertains to Example 4 (invention). The bottom curve, with points indicated by non-solid triangles, pertains to Example 6 (15% diluted control). The "x" axis, is the shear rate, in $\gamma[s^{-1}]$ units; while the "y" axis is viscosity in centiPoise or milliPascals-second.

Figure 1:
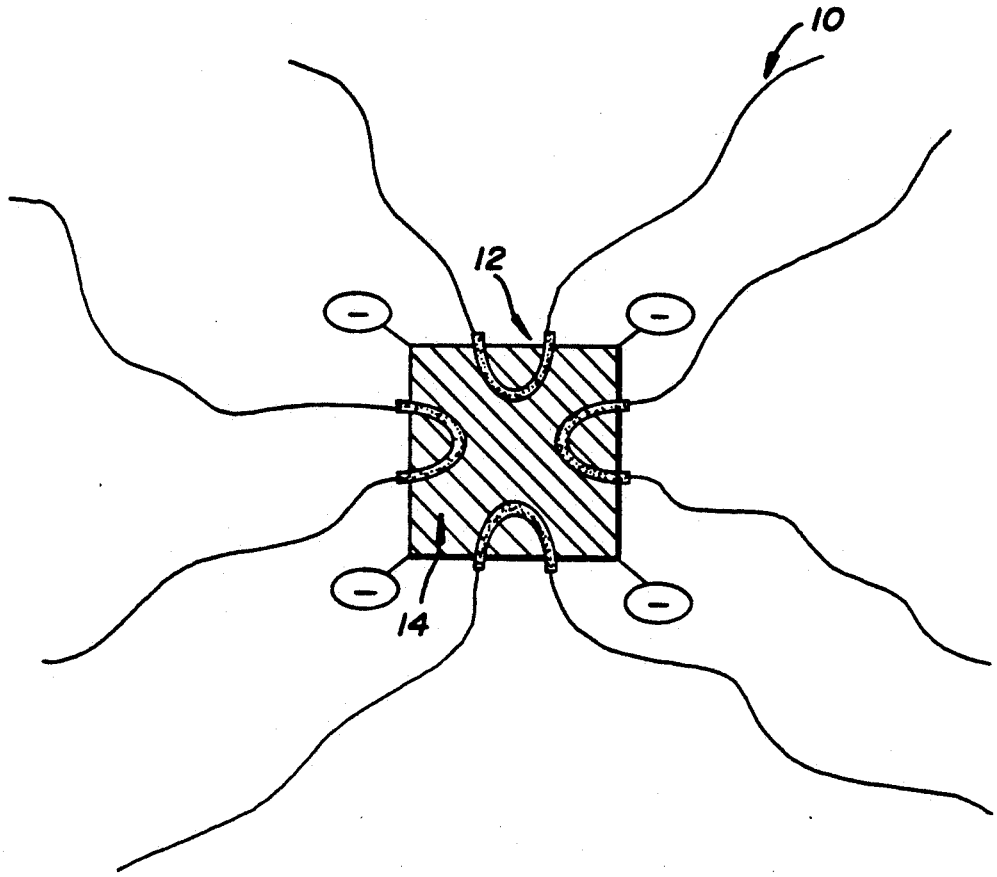
FIG. 1. Attachment of multiple gelatin molecules to a photographic agent molecule FIG. 2. Attachment of multiple units of FIG. 1 to each other FIG. 3. Attachment of multiple anionic photographic agent molecules to a gelatin molecule FIG. 4. Binding of inventive compounds to gelatin and viscosity enhancing photographic agents.

There are two sets of curves in FIG. 6. The "y" axis is density, and the "x" axis is exposure step, in each graph. In each graph, there are three pairs of tracings for blue (top), green (middle) and red (bottom). In each case, the solid line is for the control (Example 7). In the top curve, (A), the dashed tracings are for Example 8, where activity of a prior art compound, Pluronic L-44, is set forth. In graph (B), the dashed tracings relate to Example 9, where activity of a compound within this invention (APG-225 glycoside) is set forth. Comparison of graphs A and B illustrate the unexpected nature of this invention.

MODES FOR CARRYING OUT THE INVENTION

A further embodiment of the invention is the reduction of melt viscosities of the types of coating melts in question using a mixture of addenda of Type A or Type B with the type of prior art compounds described previously in Table I, in proportion such that no or substantially no adverse photographic effect is observed.

For the purpose of this invention, terms in quotation marks below have the following meanings:

an "Amphiphilic" molecule is one that contains both hydrophilic (water soluble, e.g., polar group or charged group) and hydrophobic (water insoluble, e.g., mainly hydrocarbon or fluorocarbon rich group) segments;

Viscosity requirements for individual melts in multilayer coatings depend on the method and equipment (e.g. bead or curtain coating) used for the coating process and upon many other considerations. Therefore, the ideal viscosity for any coating melt is a small range that is most desirable for particular coating machine and melt composition. The broad objective of this invention is to provide a means for the reduction of viscosity of a photographic melt, containing the type of viscosity enhancing melt component of this invention (described earlier), to a given value that is ideal for a particular coating process and equipment. For this purpose the lowest viscosity needed to be attained may lie anywhere between 3 to 200 cP (mP*s) at low shear rate (less than 100 sec.$^{-1}$). A preferred range is below 50cP (mP*s). Therefore the term "excessive viscosity" of a coating melt is any viscosity that is significantly higher than the range necessary for providing imperfection free or substantially imperfection free coatings in a given manufacturing coating machine.

"Substantially imperfection free multilayer coatings" are such coatings that do not contain observable or measurable layer thickness variations and nonuniformity in the individual layers of the multilayer product coatings. The extent of nonuniformity which is acceptable depends upon the type, the end product and its usage.

"Hydrophilic chains" are segments of molecules that are composed of repeating segments (which may be repeating oligomers, e.g., polyalkylene oxide groups or polysaccharides) that by themselves are water miscible.

As can be seen by the descriptions of the amphiphilic compounds of Type A, Type B, and those of the prior art set forth in Table I, these molecules have rather bulky hydrophilic groups. Although not bound by any theory, it is believed that these amphiphilic molecules attach (by some undetermined mechanism) to both gelatin and the anionically charged photographic agents with large hydrophobic groups, and sterically prevent or retard the bulky photographic agents from becoming attached to the gelatin molecules.

Whatever the mechanism involved, the ability of addenda, of the types employed in the invention, to reduce viscosity levels from those that cause problems, to lower levels in which satisfactory coatings can take place, is not taught in the art. Furthermore, the ability of such amphiphilic compounds, to efficaciously reduce excess viscosity levels and not to have an adverse photographic sensitometric effect is entirely unexpected. Moreover, the compounds employed in this invention have little or no deleterious effect on the other ingredients present in melt compositions.

In view of these benefits, it is believed that the instant invention is a significant improvement in the art. Furthermore, because of the efficacious results obtained, and the ease in which this invention is carried out, it is readily adaptable by industry.

As indicated at various locations of this specification, there are some important features of this invention which can serve to distinguish it from other compositions and processes. First, this invention is directed to the preparation and use of compositions in which there is a photographic chemical that is water soluble, or is rendered water soluble by the addition of a minor amount of an assisting solvent such as a lower alcohol or ketone. In other words, this invention is not directed to the use of amphiphilic compounds in photographic melts that contain dispersions of insoluble couplers or other photographic agents. In this invention, the amphiphilic compounds are employed with photographic chemicals that are present as solutes in an aqueous solution that may also contain a water miscible, polar organic solvent.

Secondly, this invention is directed to the use of amphiphilic compounds (of a specified type or types) with photographic agents that are anionically charged. By anionically charged, it is meant that the photographic agents have at least one anionic group per molecule, i.e., one or more groups in a negatively charged state. Thus, this invention pertains to use of amphiphilic compound(s), as specified herein, with a photographic chemical which is derived by removal of a hydrogen ion from an acidic function. Thus this invention is directed to compositions in which there is at least one anion produced by removal of a hydrogen ion from a group such as —COOH, —$SO_3H$, —$SO_4H$, or the like. Stated another way, this invention relates to carboxyl, sulfonyl, sulfate or similar group in the molecule Typically, the chemical has from one to about three such anionic groups present per molecule Thus for example, the photographic compound may have one, two or three -$SO_3^-$ groups per molecule, and similarly, the compound may have one, two, or three -$COO^-$ groups. When it is desired to apply this invention to the use of a compound having one or more carboxy groups, the pH of the media in which it is employed must be from about 4 or higher, so that the requisite carboxyl group(s) are ionized, that is, negatively charged. Obviously, similar considerations apply to the use of materials that contain a sulfonate or a sulfate group or the like, but in those instances the pH may be even lower, since they are derived from more easily ionized acids. Stated another way, when the anionic compound is other than carboxylate, and has an anionic group such as sulfate or sulfonate group, the pH can be in the range that is commonly employed for producing silver halide-based photographic emulsions, i.e., a pH of say from about 4 to about 10. These compounds could also be in their alkali metal or quaternary ammonium salt form, where the ionic groups are fully dissociated and charged.

In a preferred embodiment this invention is directed to a melt for the coating of a layer in a photographic element and which contains gelatin and an anionially charged, hydrophobic group containing compound that is (a) water soluble or rendered water soluble or rendered water soluble by solvent assistance, and (b) which confers an undesirably high viscosity on gelatin melts, said melt being further characterized by containing an amount of an amphiphilic compound which is sufficient to reduce the viscosity of said melt to desirable values as indicated earlier, said compound selected from the class consisting of Type (A): Sugar (saccharidic) compounds, comprising between one to three hydrophobic groups, each having from about 6 to about 22 carbon atoms, and having one or more attached hydrophilic mono- or oligosaccharidic hydrophilic chains that may or may not be terminated by a negatively charged group such as a sulfate, sulfonate, or carboxy group, and Type (B): Compounds having a 6 to 22 carbon atom hydrophobic group, and having one or two attached hydrophilic chains comprising at least 4 oxyethylene and/or glycidyl ether groups, that may or may not be terminated with a negatively charged group such as a sulfate group.

A preferred embodiment of this invention comprises melts in which the anionically charged, hydrophobic group containing compound has an anionic charge conferred by having from one to about three $-SO_3^-$ groups, sulfate groups or carboxy groups Preferred hydrophobic group containing compounds of this type are selected from masking couplers, oxidized developer scavengers, ultraviolet radiation absorbers, optical brighteners, bleachable dyes, dye transfer dyes, and dyes. In such compounds it is preferred that the counter ions for the $-SO_3^-$ groups, sulfate groups or carboxy groups be selected from alkali metal cations; more preferably sodium and potassium. It is preferred that the coating melts have a composition such as set forth in the following:

Coating Melts of the Invention

| Component | Composition (weight percent) Preferred | More Preferred |
|---|---|---|
| (a) gelatin | 3-20 | 4-15 |
| (b) silver halide emulsion | 0-50 | 0-40 |
| (c) coupler dispersion | 0-40 | 0-30 |
| (d) anionically charged, hydrophobic group containing compounds pertaining to this invention | 0.1-10 | 0.1-5 |
| plus | | |
| (e) amphiphilic compounds of Type (A) or Type (B) | 1-10 times weight of (d) | 1-6 times weight of (d) |

Of the amphiphilic compounds employed in this invention, Type (A) compounds are preferred over Type (B) compounds.

The soluble photographic addenda or agents that produce high viscosity in gelatin-containing melts, usually have the following criteria.

1. They are molecules with large hydrophobic groups solubilized by one or more fully charged anionic groups such as $-SO_3^-$ groups, sulfate groups or carboxy groups.

2. The water solubility characteristics range from fully water soluble, to water solubility in a blend of about 5 to about 20% by weight of a water miscible organic solvent such as methanol, ethanol, propanol, isopropanol, acetone, methyl ethyl ketone, ethyl acetate, etc. at temperature between 35° to 50° C. (Use of such a water miscible solvent in the amount specified is referred to herein as "solvent enhanced" or "solvent enhancement".)

3. They are usually added to melts containing gelatin and other photographic components from a clear aqueous or a mixed solvent solution, such that the temperature of the mixture of the solution and the gelatin solution is between 35° to 50° C.

Specific classes of such photographic agents and examples are given in the following.

1. Masking Couplers (M-1)

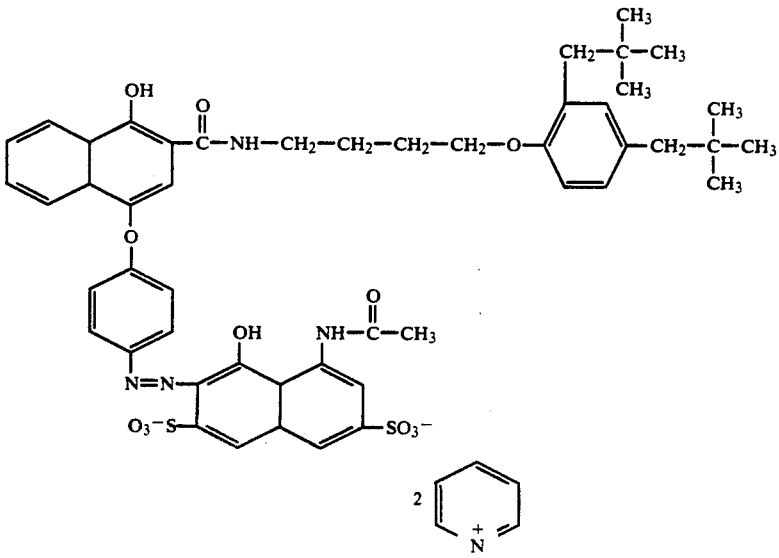

-continued
(M-2)
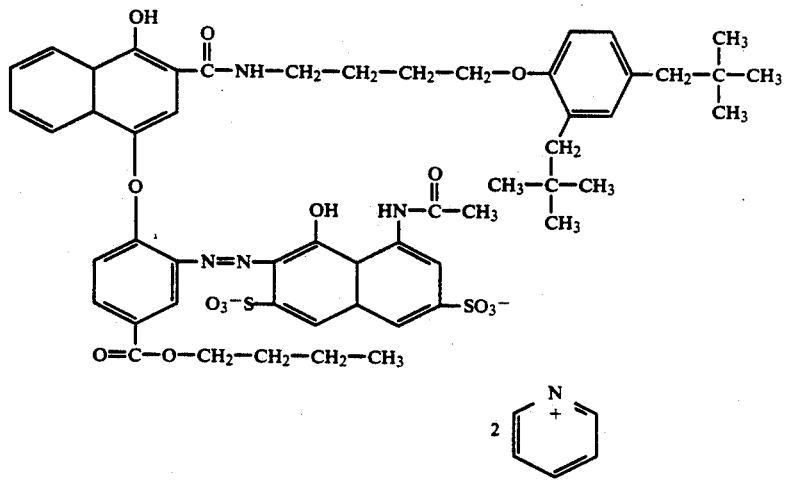
(M-3)
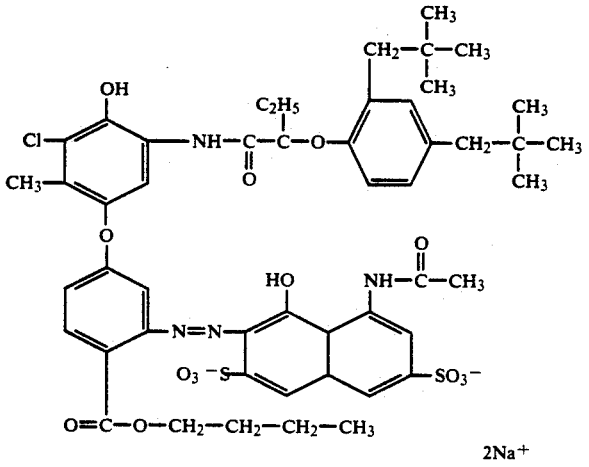
2. Oxidized Developer Scavengers
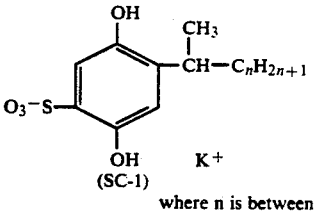
(SC-1)
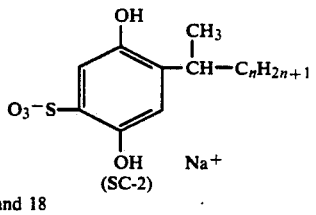
(SC-2)
where n is between 10 and 18
3. Ultraviolet Radiation Absorbers
(UV-1)
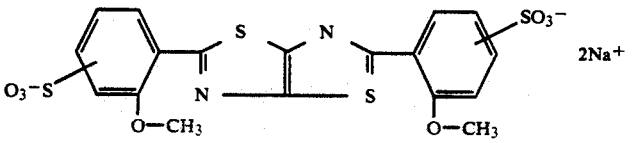
4. Optical Brighteners -continued
(OB-1)
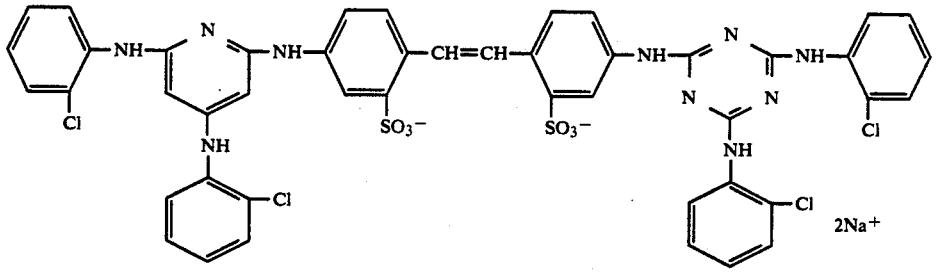
(OB-2)
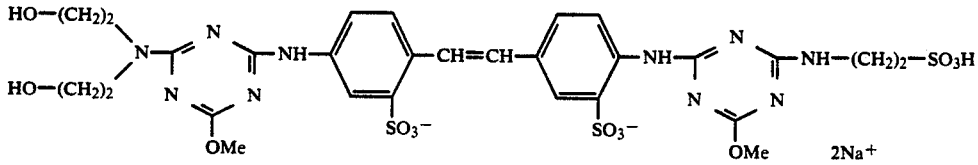
(OB-3)
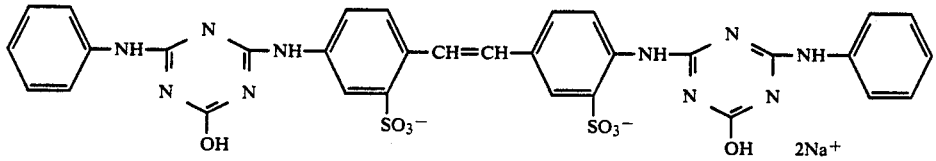
(OB-4)
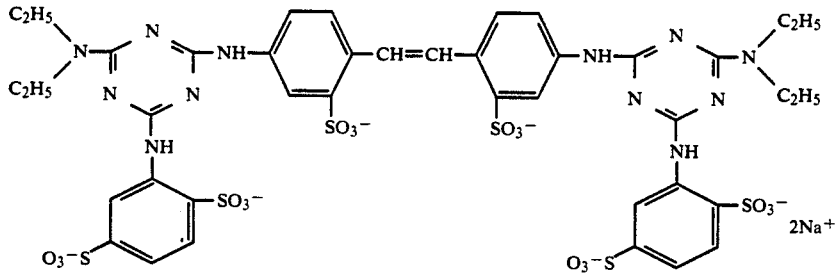
(OB-5)
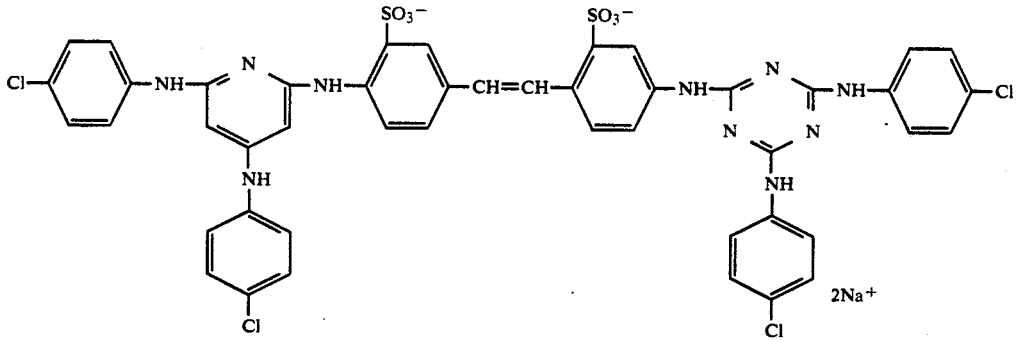
5. Bleachable Dyes
(BD-1)
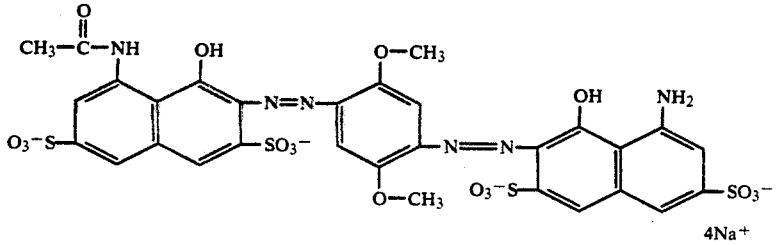

-continued
(BD-2)
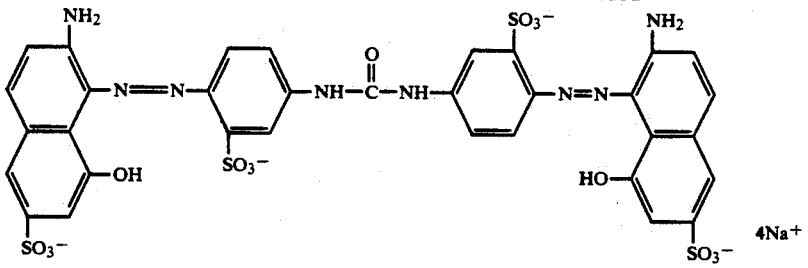
(BD-3)
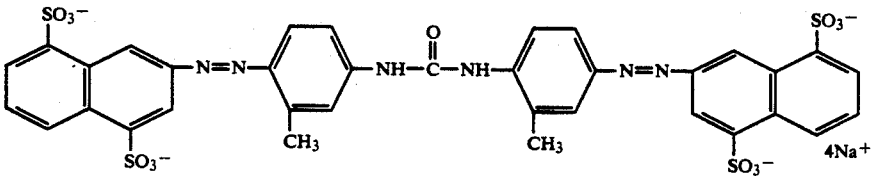
6. Dye Transfer Dyes
(DTD-1)
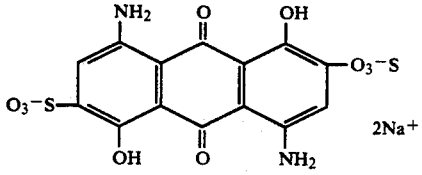
(DTD-2)
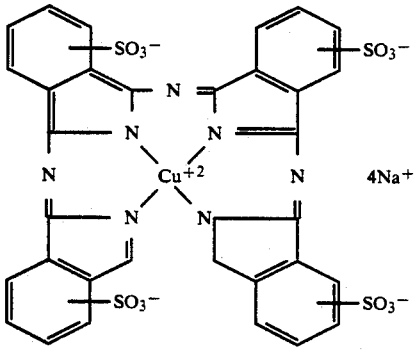
(DTD-3)
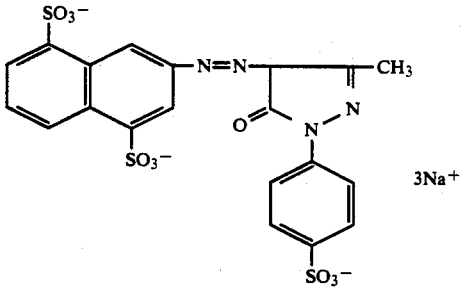
(DTD-4)
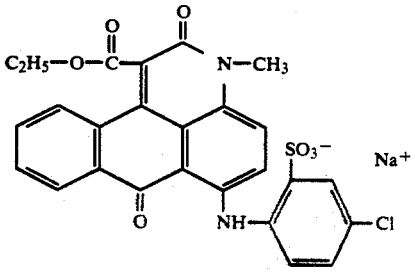
7. Dyes -continued (D-1)

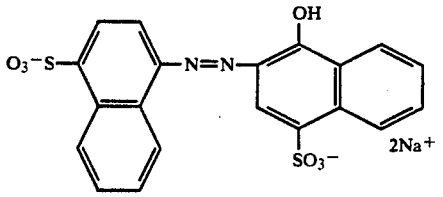

(D-2)

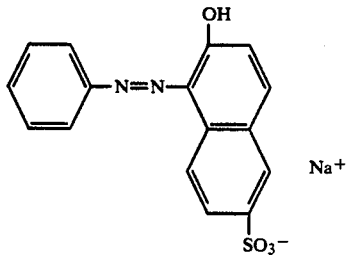

(D-3)

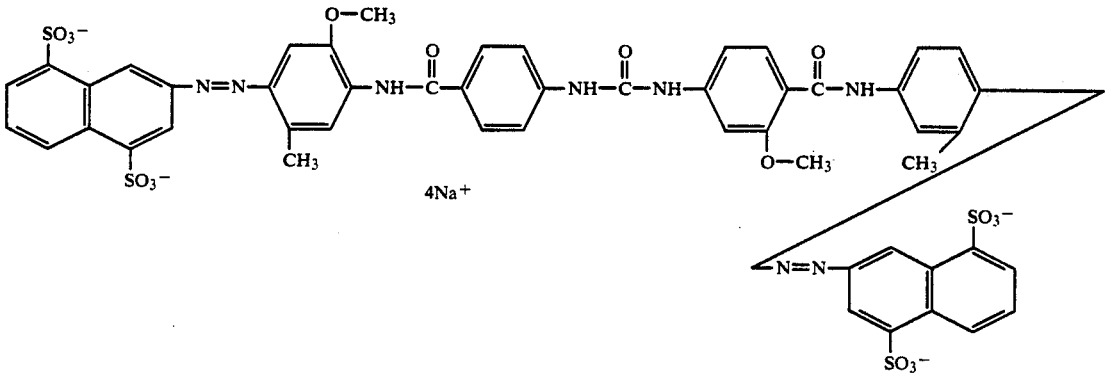

(D-4)

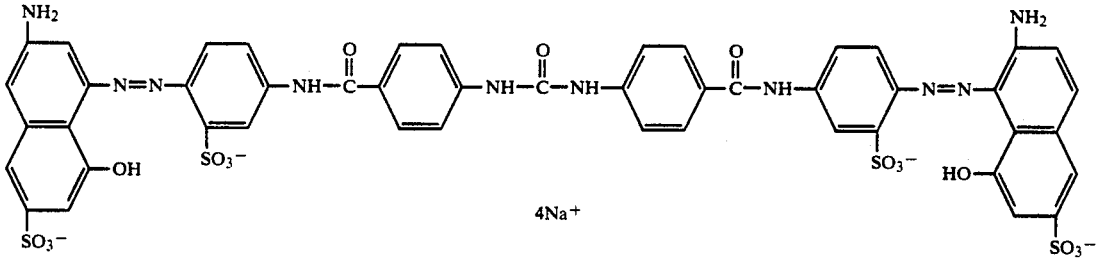

(D-5)

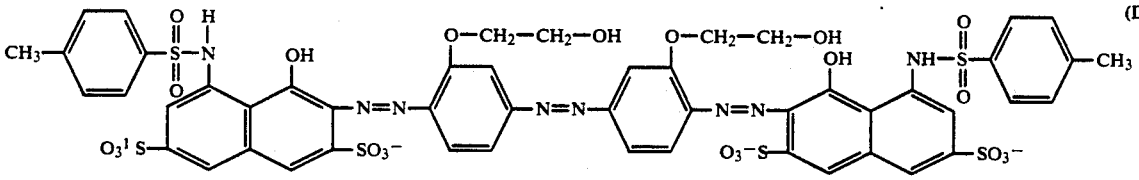

Figure 2:
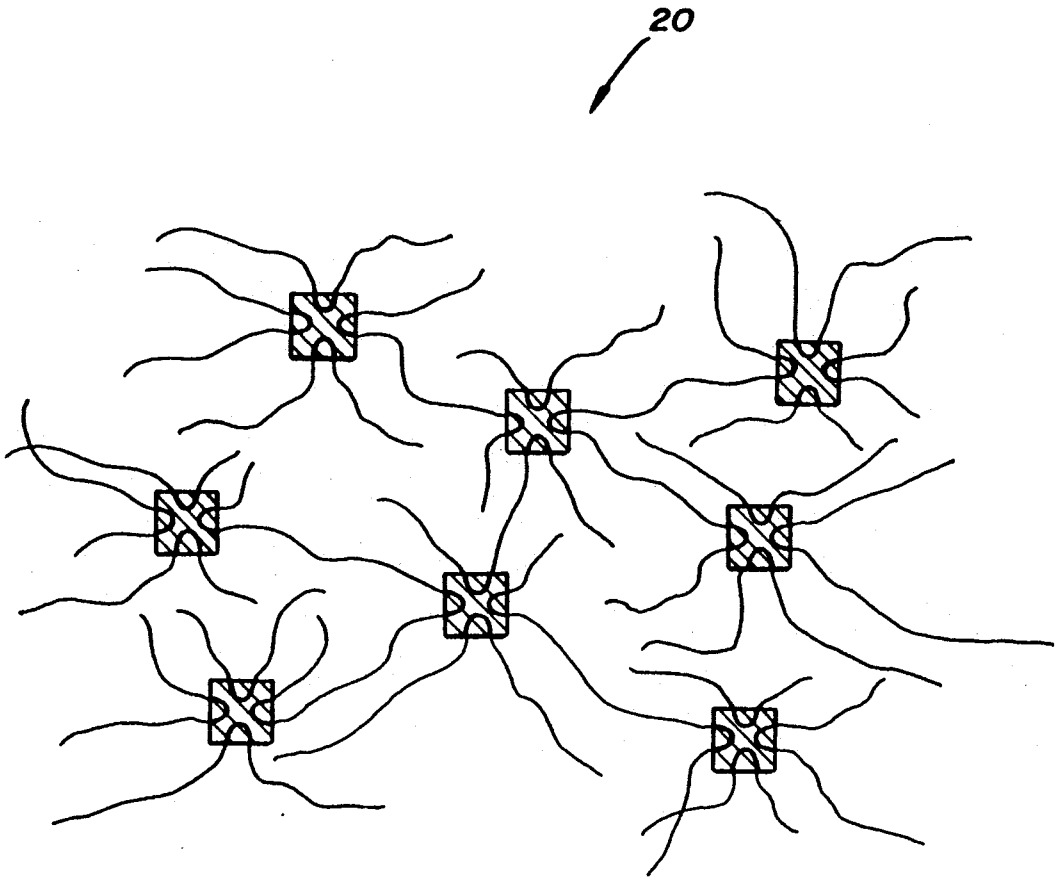

There are a number of reasons why such photographic agents, when added to gelatin can cause high viscosity. FIG. 1 shows that gelatin molecules 10 have hydrophobic segments 12 (marked heavy). Using such hydrophobic segments 12, they can attach to the hydrophobic areas of the charged photographic agents in question, thereby effectively increasing the molecular weight of the gelatin in the melt by the attachment of multiple gelatin molecules to the photographic agent. Attachment of multiples of such units to each other (as shown in FIG. 2) can not only produce extremely excessive viscosity and shear thinning characteristics, but also time dependent increase of held gelatin melts, which is extremely detrimental for producing reproducible coating melts.

Figure 3:
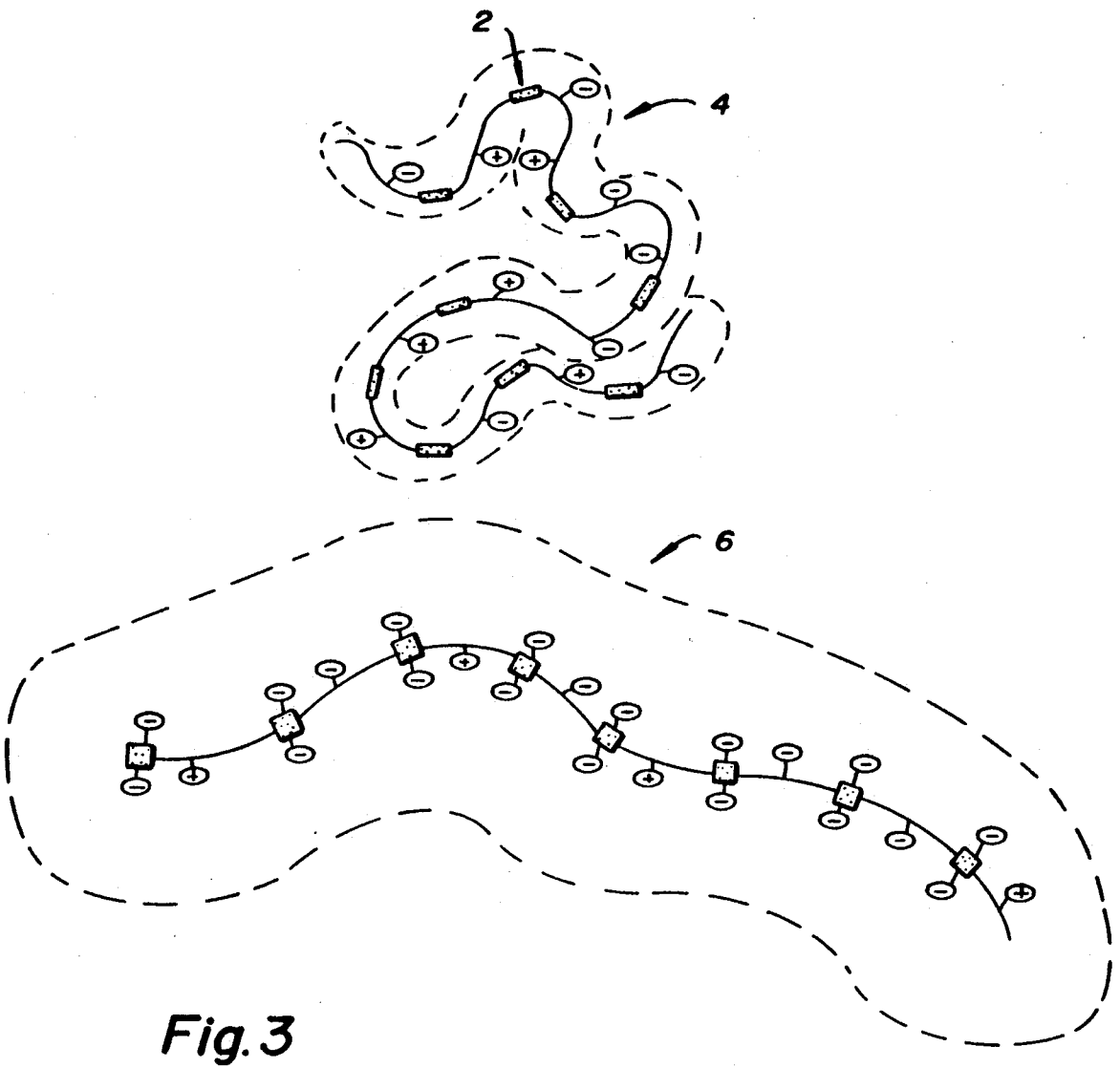

Gelatin is a polypeptide with pendant carboxyl and various amine groups. At any given pH, depending upon the pka of the amine groups, the gelatin molecule has both positive and negative charges (ef. T. H. James, "*The Theory of the Photographic Process*", 4th Ed., MacMillan, N.Y., 1977). As shown in configuration 4, of FIG. 3, due to the partial neutralization of the various ionized groups, the gelatin molecule is fairly compactly coiled, especially so near the isoelectric point of the gelatin molecule. In Configuration 4, of FIG. 3, the hydrophobic sections of the gelatin molecule are marked with heavier lines designated by 2. Negatively charged smaller hydrophobic molecules, such as those of the photographic agent in question, may individually bind to the hydrophobic sites of the gelatin molecule and render it highly charged. In such a case, due to charge repulsion, the gelatin molecule will acquire a highly expanded structure as shown in Configuration 6 of FIG. 3. This process of enhanced excluded volume will also lead to extreme enhancement of viscosity of the gelatin melt, and is an alternate mechanistic explanation for the viscosity enhancement process discussed earlier.

The viscosity reducing compounds of this invention, as indicated by Type-A and Type-B, are exemplified with structure given in the following.

Type-A Compounds

SA-1

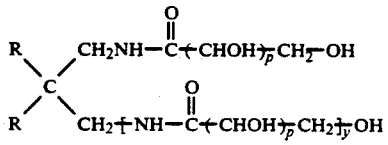

where, R = $H(CH_2)_n$
n = 4 to 8 or

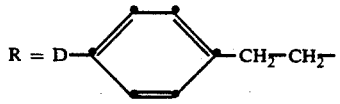

p = 3 to 10
D = $(CH_2)_z$
y = 0 or 1

SA-2

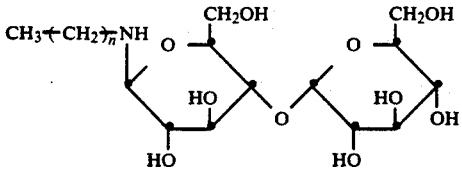

where, n = 3 to 15

SA-3

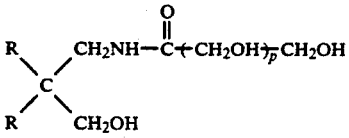

where, R = n-$CH_3(CH_2)_x$ (where x = 3 to 7)

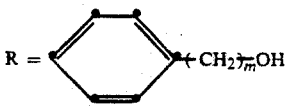

p = 3 to 15
m = 2 to 5

-continued

Type-A Compounds

SA-4

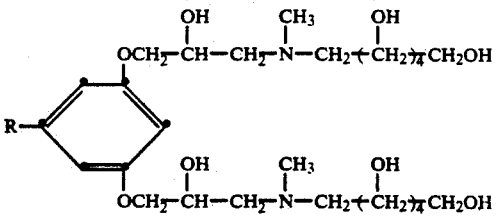

where, R = n-$CH_3(CH_2)_x$
(where, x = 5 to 14)

SA-5

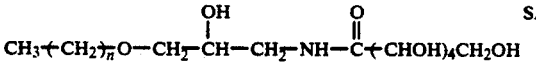

where, n = 3 to 15

SA-6

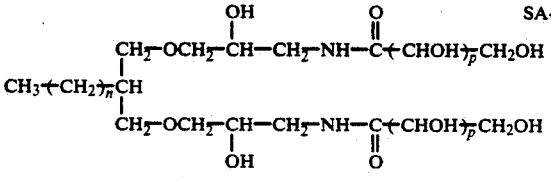

where, n = 2 to 12
p = 3 to 10

SA-7

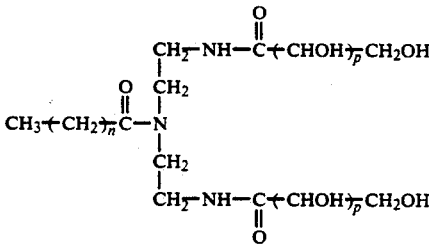

where, n = 6 to 18
p = 3 to 10

SA-8

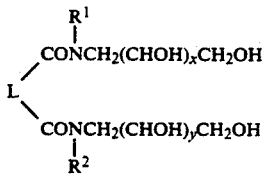

wherein

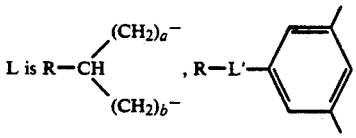

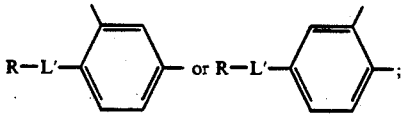

L' is a chemical bond, —O—, —S—, —NH—, —CONH— or —$SO_2$NH—; R is a hydrophobic substituted or unsubstituted alkyl, or a substituted or unsubstituted coalkyl, or a substituted or unsubstituted aryl group containing 8 to 20 carbon atoms;

each $R^1$ and $R^2$ independently is hydrogen or an alkyl group having form 1 to 4 carbon atoms;

each of a and b independently is 0 or an integer from 1 to 3, provided that the sum of a and b is not greater than 3; and, each of x and y independently is an integer from 3 to 7.

Alkyl Polyglycosides

SA-9

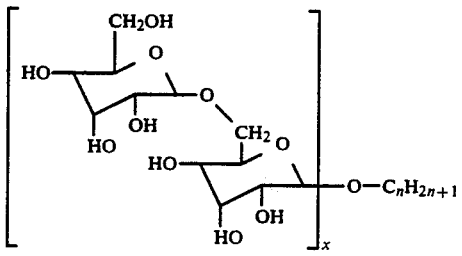

n is 8 to 14

APG 225 n is 8 and 10 and x = 1.8
APG 300 n is 9, 10 and 11 and x = 1.4
APG 325 n is 9, 10 and 11 and x = 1.6
APG 600SP n is 12 and 14 and x = 1.4
APG 625 n is 12 and 14 and x = 1.6

The alkyl polyglycosides shown above as SA-9 are the most preferred compounds for this invention, especially where n is between 8 and 11. This is because greater melt viscosity reduction is observed with these compounds at lower concentrations. Such compounds have been commercialized by Henkel Corporation and are called "APG glycosides".

Sucrose Alkyl Esters

SA-10

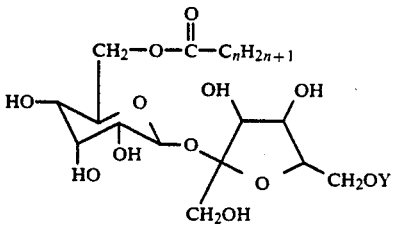

where n = 9 to 17, Y = —H or, —C(=O)—$C_nH_{2n+1}$

Sucrose Alkyl Amide and Ether

SA-11

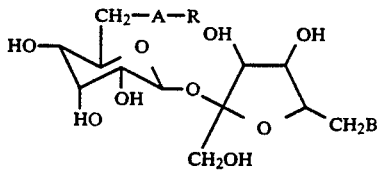

where R = —$C_{10}H_{21}$ to —$C_{18}H_{37}$ and —A— is —O—C(=O)—NH— or —O— and B is —OH or —A—R Other examples of Type-A compounds can be found in an article by Latge et al., J. Dispersion Science and Technology, Vol. 12, pp. 227-237 (1991), which is included by reference herein.

| Type - B Compounds | |
|---|---|
| SB-1 Olin 10G (Olin) | 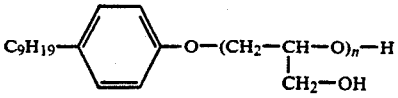 n = 5-12 (mixture) |
| SB-2 Polystep B-23 (Stepan) | n-$C_{12}H_{25}$—O—($CH_2$—$CH_2$—O)$_{12}$—$SO_3^-Na^+$ |
| SB-3 Triton X-102 (Union Carbide) | 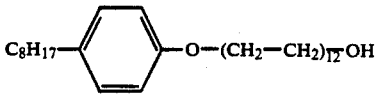 |
| SB-4 Trycol 5964 (Henkel) | n-$C_{12}H_{25}$—O—($CH_2$—$CH_2$—O)$_{23}$—OH |
| SB-5 Avanel S-150 (PPG/ Mazer) | $C_{10}H_{21}$—O—($CH_2$—$CH_2$—O)$_{15}$—$CH_2$ \| $Na^+SO_3^-$—$CH_2$ |

Figure 4:
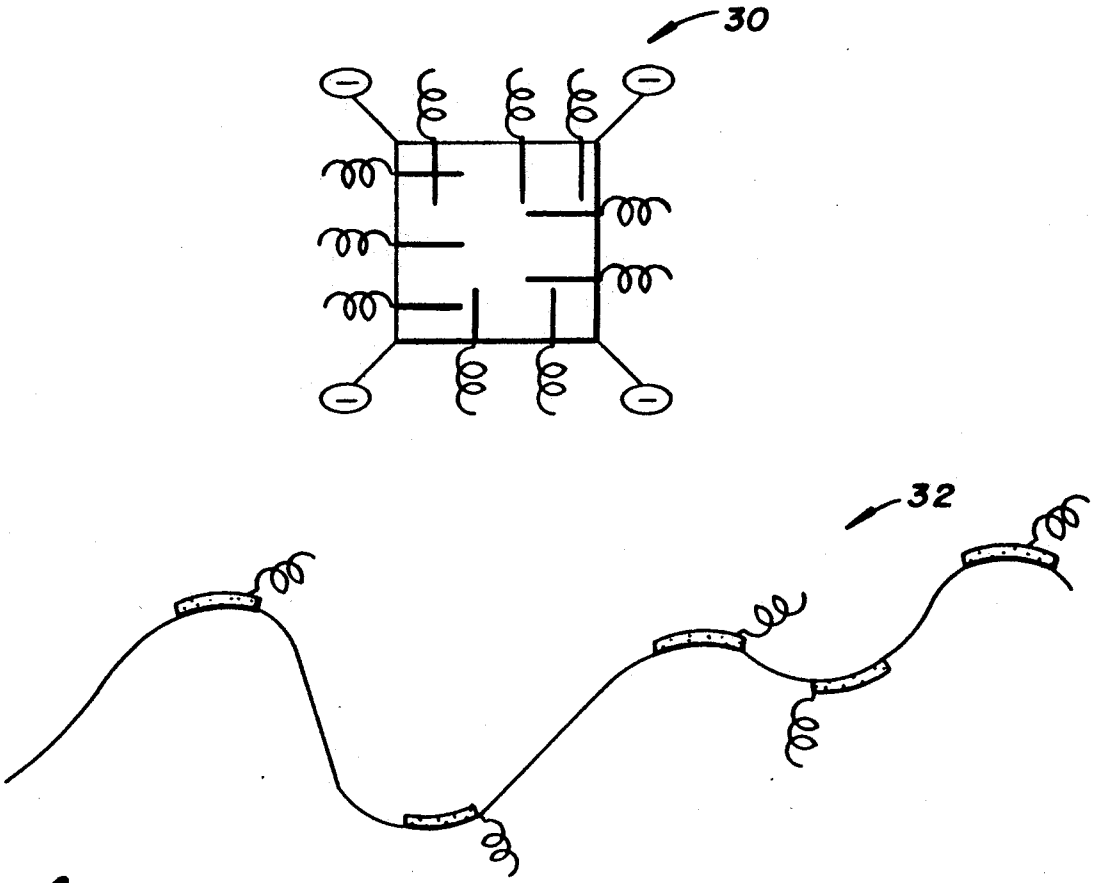

The viscosity reducing compounds of the prior art (U.S. Pat. No. 3,676,141) which are listed in Table I, and the Type-A and Type-B compounds of this invention, all contain long hydrophilic chains that are either polyether or sugar groups. This is a primary characteristic of the effective viscosity reducing agents. Although not bound by any theory, it is theorized that such effective viscosity reducing compounds attach to both the photographic agent (30 of FIG. 4) and to gelatin, using their hydrophobic groups (32 of FIG. 4), and prevent the photographic agent attaching to gelatin by steric hindrance of the water soluble hydrophilic groups associated with the amphiphilic compounds. Since, in this manner, the photographic agents can not attach to gelatin, viscosity enhancement does not take place in the presence of the compounds of this invention or those of prior art as indicated in Table I.

Coating Format of Multilayer Color Negative Film

A coating format for illustration of this invention is the following layer sequence on a transparent support of cellulose triacetate. The various laydowns are given in mg per sq. ft. The quantities in parentheses "()" are in mg per sq. m. Surfactants, coating aids, absorber dyes, and stabilizers are added to the various layers of coating as commonly practiced in art. All silver halide emulsions were stabilized with 1 75 grams of 4-hydroxy-6-methyl-1,3,3a,7-tetraazaindene per mole of silver.

Layer 1 (Antihalation Layer): Black colloidal silver sol containing 22 mg of silver and 235 mg (2408 mg) of gelatin.

Layer 2: (First Red-Sensitive Layer): Red sensitized silver iodobromide emulsion (4.5% iodide, tabular grains with average grain diameter 1.0 micron and average grain thickness 0.1 microns) 100 mg (1070 mg), red sensitized silver iodobromide emulsion (0.5 mole percent iodide, cubic grains with average edge length 0.21 microns) 100 mg (1070 mg), cyan dye-forming image coupler (X-1) 52 mg (556 mg) cyan dye-forming development inhibitor release (DIR) coupler (X-2) at 2.6 mg (28 mg) and gelatin at 250 mg (2675 mg). This is the slow cyan layer.

Layer 3: (Second Red-Sensitive Layer) Red sensitized silver idobromide emulsion (3% iodide, octahedra of mean diameter 0.95 microns) 120 mg (1284 mg), cyan dye-forming image coupler (X-1) 9.5 mg (102 mg), cyan dye-forming DIR coupler (X-2) 0.6 mg (6.4 mg), DIR coupler (X-3) 4.5 mg (48 mg), cyan dye-forming masking coupler (M-1) 3.0 mg (32 mg) and gelatin 220 mg (2354 mg). This is the fast cyan layer, and is varied to illustrate the invention; see the examples below.

Layer 4: (Interlayer) Oxidized developer scavenger (X-4) 4 mg (43 mg) and gelatin 80 mg (856 mg).

Layer 5: (First Green-Sensitive Layer) Green sensitized silver iodobromide emulsion (3% iodide, tabular grains with average grain diameter 0.7 microns, and average grain thickness 0.1 microns) 86 mg (920 mg), green sensitized silver iodobromide emulsion (0.5% iodide, tabular gains with average grain diameter 0.5 diameter 0.5 microns and average grain thickness 0.1 microns) 50 mg (535 mg) magenta dye-forming image coupler (X-5) 58 mg (621 mg), magenta dye-forming masking coupler (X-7) 2.0 mg (21.4 mg) and 225 mg (2408 mg) of gelatin. This is the slow magenta layer.

Layer 6: (Second Green-Sensitive Layer) Green sensitized silver iodobromide emulsion (6%I, tabular grains with average grain diameter 0.95 microns and thickness 0.1 microns) 125 mg (1338 mg), magenta dye-forming image coupler (X-8) 10.5 mg (112 mg), magenta dye-forming DIR coupler (X-6) 0.4 mg (4.3 mg), yellow dye-forming DIR coupler (X-9) 7.0 mg (73 mg), magenta-dye forming masking coupler (X-7) 4.0 mg (43 mg), oxidized developer scavenger (X-4) 1.5 mg (43 mg) and 240 mg (2568 mg) of gelatin. This is the fast magenta layer.

Layer 7: (Interlayer) Developer bleachable yellow filter dye (X-10) 18 mg (193 mg), oxidized developer scavenger (X-4) 7 mg (73 mg) and gelatin 80 mg (832 mg).

Layer 8: (First Blue Sensitive Layer) Blue sensitized silver iodobromide emulsion (6% iodide, octahedra with average diameter of 0.65 microns) 20 mg (214 mg), blue sensitized silver iodobromide emulsion (4.8% iodide, three dimensional grain average diameter of 0.26 microns), yellow dye forming image coupler (X-11) at 125 mg (1338 mg) arous sulfide 3.3 mg (35 mg) and gelatin 132 mg (1412 mg) This is the slow yellow layer The conventional hardener bisvinyl-sulfonyl methane is added in this layer for the film pack at 2% of the total gelatin in the film packet.

Layer 9: (Send Blue Sensitive Layer) Blue sensitized silver iodobromide emulsion (6% iodide, octahedra with average diameter of 0.89 microns) 40 mg (428 mg), yellow dye-forming image coupler (X-11) 5 mg (54 mg), arous sulfide 6.5 mg (70 mg) and gelatin at 100mg (107 mg). This is the fast yellow layer.

Layer 10: (First Protective Layer) Ultraviolet (UV) absorbing dye (X-12) at 10 mg (107 mg), UV absorbing dye (X-13) at 10 mg (107 mg), gelatin at 155 mg (1658 mg), and unsensitized silver bromide Lippman emulsion (0.04 microns diameter) at 20 mg (214 mg).

Layer 11: (Second Protective Layer) Anti-matte polyvinyltoluene beads at 4.1 mg (44 mg) and 82 mg (877 mg) of gelatin.

The aurous sulfide was added as a fine dispersion in gelatin Compounds (X-1), (X-4), (X-8), (X-9) and (X-11) were added as conventional milled dispersion containing di-n-butylphtalate. Compounds (X-2), (X-3), (X-5), (X-6) and (X-7) were added as conventional milled dispersions containing tricresylphosphate. Compounds (X-12) and (X-13) were added as conventional milled dispersion containing the following permanent solvent.

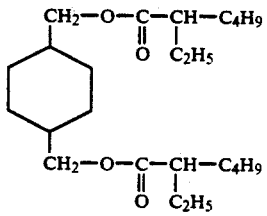

Compound (M-1) was added to an aqueous solution containing 2% Dowanol EP. Compound (X-10) was incorporated as a ballmilled mirocrystalline dispersion.

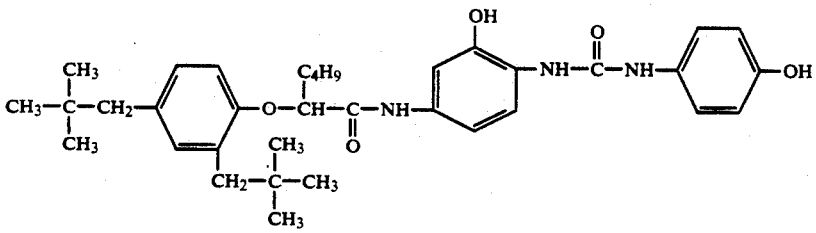

(X-1)

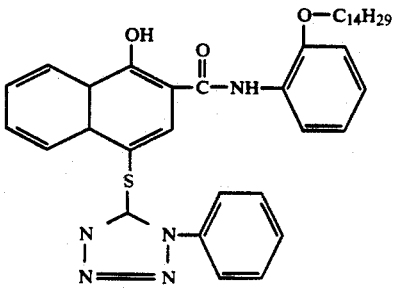

(X-2)

-continued
(X-3)
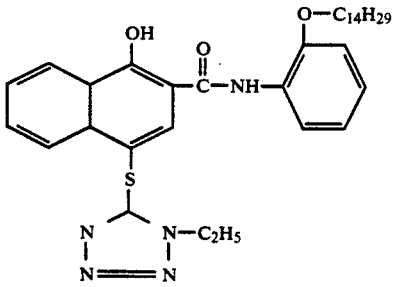
(X-7)
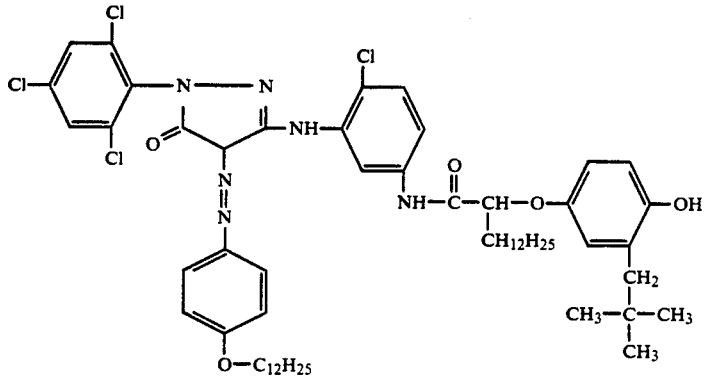
(X-8)
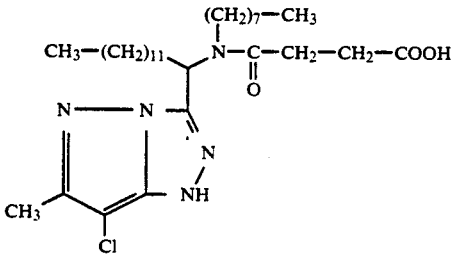
(X-9)
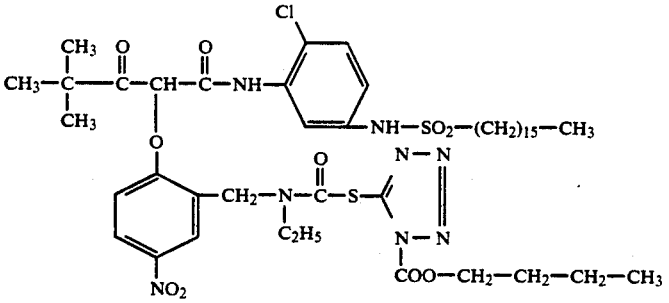
(X-10)
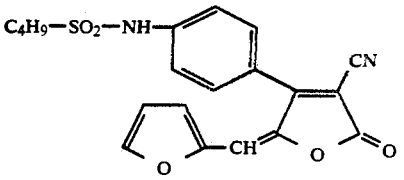

-continued

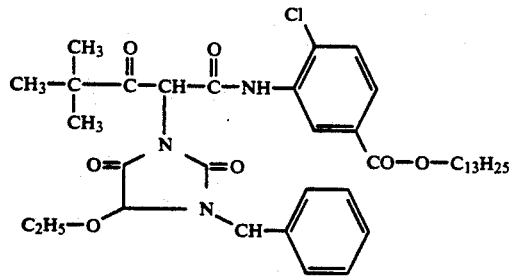

(X-11)

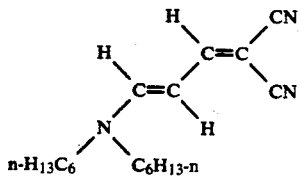

(X-12)

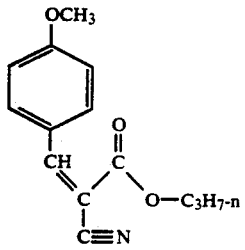

(X-13)

Gelatin coated samples were exposed to white light through a grey wedge chart. These samples were then developed using a color negative process, the KODAK C-41 process as described in Anonymous Disclosure, "Photographic Silver Halide Emulsions, Preparations, Addenda, Processing and Systems," *Research Disclosure,* 308, p 933–1015 (1989) and sensitometry was carried out in the standard manner.

EXAMPLES

The following examples are intended to be illustrative and not exhaustive illustrations of this invention. Parts and percentages are by weight unless otherwise specified.

EXAMPLES 1 THROUGH 6: PREPARATION OF INVENTIVE AND PRIOR ART FAST CYAN MELTS OF LAYER #3 AND THEIR RHEOLOGICAL BEHAVIOR

In these examples, it is demonstrated that when cyan dye-forming magenta masking coupler (M-1) is admixed with gelatin to form a photographic coating melt, there is observed a large increase in melt viscosity. When predetermined amounts of the invention compound (SA-9, APG 225 and APG 300), and a prior art compound (PA-1; Pluronic L44) are individually added to such melts, there occurs a drastic reduction of viscosity.

To demonstrate this invention, fast red test layer melts were prepared according to our test film format (Layer #3) in variations of Examples 1 through 6. The varied components are indicated in Table II. All other components of melts of Examples 1 through 6 were the same as that for layer #3 of the test coating format, and also identical to each other.

The masking coupler (M-1) was added from a solution prepared by dissolving 130 g. of (M-1) and 20 ml of Dowanol EP (2-phenoxyethanol) per 1 of solution at 40° C. In Table II it is seen that the melt of Example 1, where there is no (M-1), the viscosity at 40° C. and at 80 $Sec^{-1}$ as measured by a Brookfield viscometer is 36.6 cp (mP*s). The melt of Example 2, which contains only 0.14% of (M-1) produced a viscosity of 73.7 cp (mP*s). In the melt of Example 3, to which was added 0.75% of the prior art compound Pluronic L44 (PA-1), the melt viscosity was reduced to 41.9 cp (mP*s). It will be shown in later examples that this type of prior art compound has undesirable photographic behavior which is unsuitable for product use.

Inventive Examples 4 and 5 show that the use of compound APG 300 and APG 225 also reduce the viscosity of the said melts Example 6 is a melt substantially the same as Example 2, but it has been diluted 15% as reflected in lower gel concentration It is seen that dilution has a drastic effect in lowering the melt viscosity. However, such diluted melts would be undesirable in production coating as larger amounts of water have to be removed, thereby reducing coating speed. Therefore, the reduction of high melt viscosity by dilution is not a desirable solution.

The low viscosities of the inventive melt of Examples 4 and 5 illustrate this invention.

Figure 5:
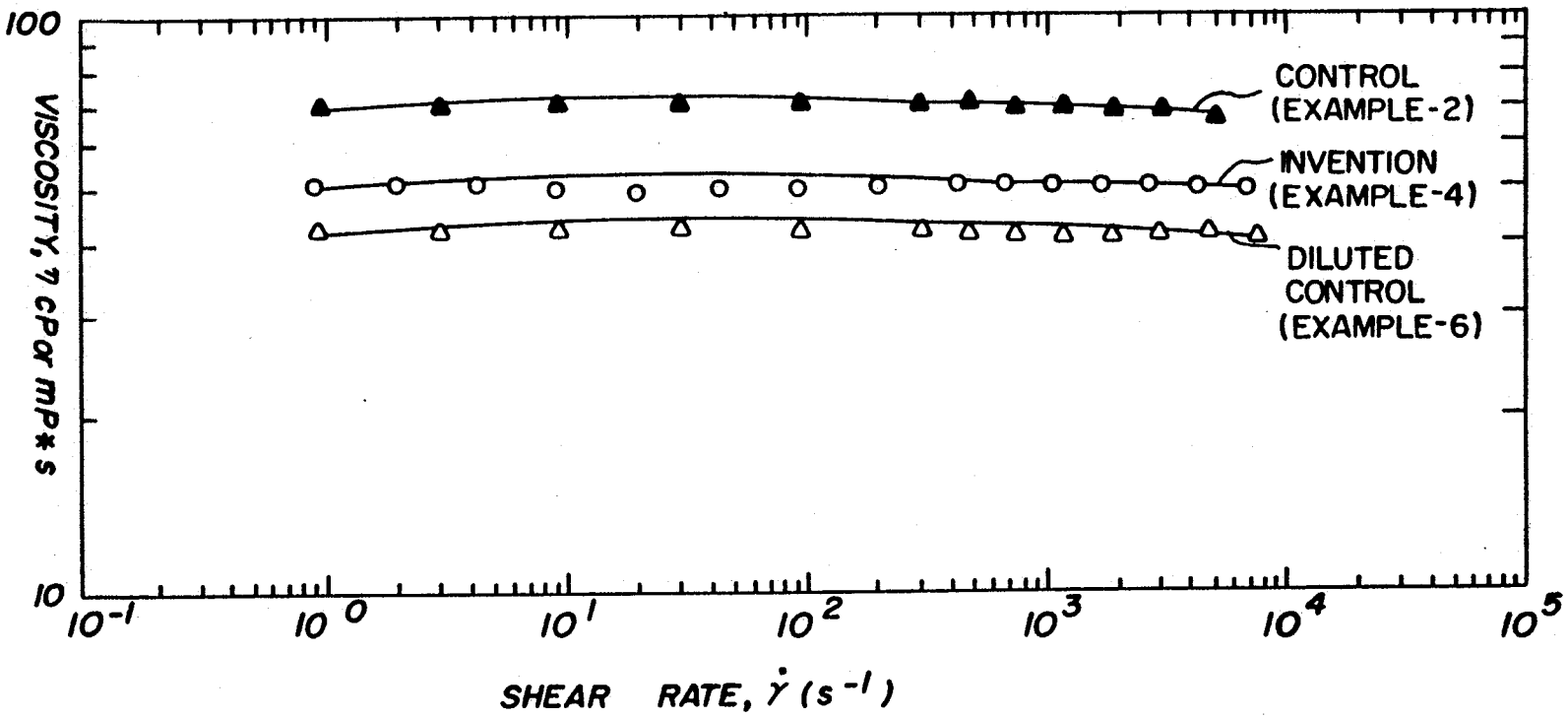
FIG. 5. Melt rheograms.

FIG. 5 shows rheograms of melts of Examples 2, 5 and 6. The rheograms of FIG. 5 show shear rate dependence of viscosity of these melts as measured by a Rheometrics "Systems II" rheogoneometer. All the melts appear to be very slightly shear thinning, probably due to disruption of structuring as indicated earlier. The melt of Example 2, which has no viscosity reducing agent produced very high viscosities unsuitable for imperfection-free multiple layer coating. The melt of Example 6 again shows that dilution drastically reduced the viscosity. However, addition of water to photographic melts increases the difficulty of drying. However, invention Example 5 indicates that use of APG 300 (SA-9) produced a reduction of melt viscosity without reduction in gelatin concentration, again illustrating practice of this invention.

EXAMPLES 7 THROUGH 9: MULTILAYER PHOTOGRAHIC EVALUATION OF FAST CYAN LAYER MELTS

Figure 6A:
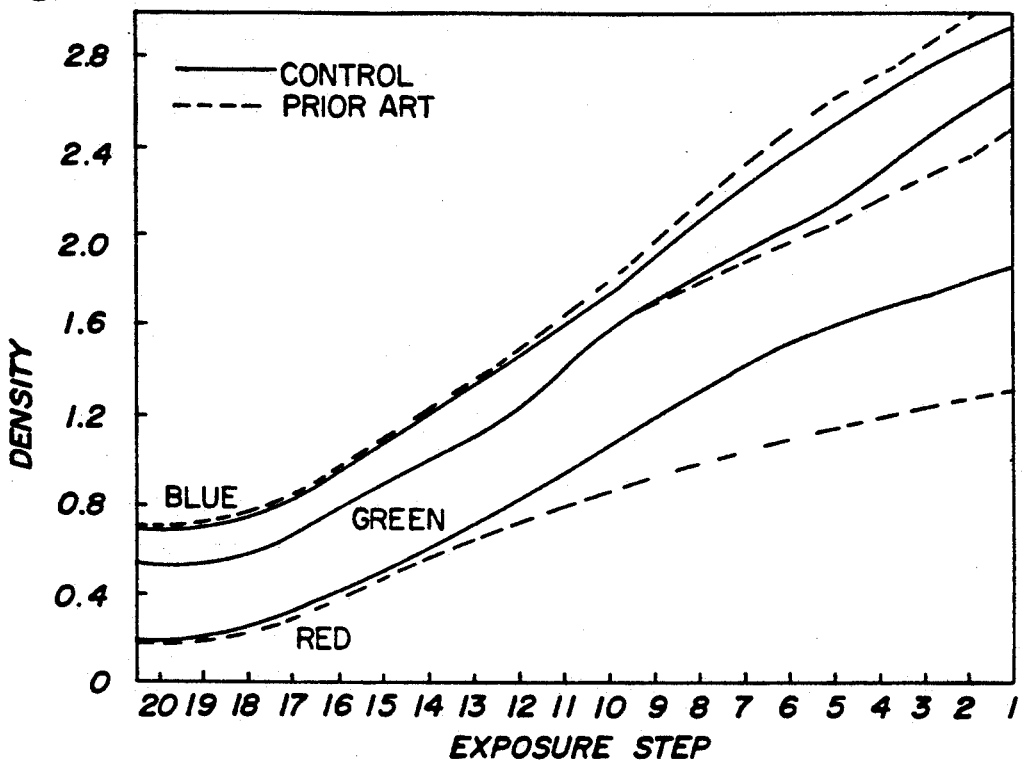
FIG. 6. Multilayer sensitometry.
Figure 6B:
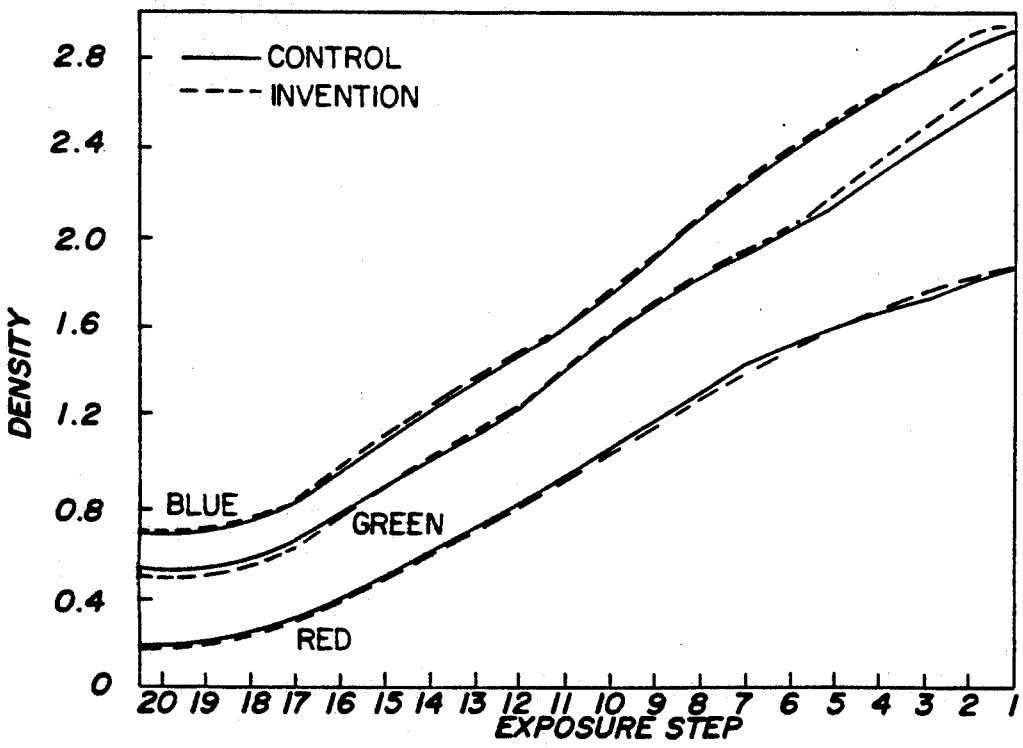

Melts of Examples 3, 5, and 6 were coated in the test multilayer film format as indicated above to produce coatings of Examples 7 through 9 as indicated in the following:

The coating of Example 7—using diluted melt of Example 6 (control, FIG. 6A and 6B).

TABLE II

Viscosity of Gelatin Melts Comprising Masking Coupler (M-1)

| Example | Melt Compositions* Gelatin % | (M-1) % | Viscosity Reducing Agent | % Viscosity Reducing Agent | Brookfield Viscosity at 40° C. and 80/sec$^{-1}$ Centipoise in mP*s | Comments |
|---|---|---|---|---|---|---|
| 1 No (M-1) (Control) | 9.91 | 0 | None | 0.00 | 36.6 | — |
| 2 (Control) | 9.91 | 0.14 | None | 0.00 | 73.7 | See FIG. 5 |
| 3 Prior Art | 9.91 | 0.14 | PA-1 Pluronic L44 | 0.75 | 41.9 | — |
| 4 Invention | 9.91 | 0.14 | SA-9 APG-300 | 0.75 | 44.6 | See FIG. 5 |
| 5 Invention | 9.91 | 0.14 | SA-9 APG-225 | 0.94 | 41.0 | — |
| 6 15% diluted Control #2 | 8.57 | 0.12 | None | 0.00 | 37.1 | See FIG. 5 |

*Contains other addenda of the fast cyan layer #3 as indicated earlier, at indentical levels in all Examples 1 through 6

Coating of Example 8—using prior art melt of Example 3 (using Pluronic L44 (PA-1) FIG. 6A)

Coating of Example 9—using inventive melt of Example 5 (using APG 225 (SA-9) FIG. 6B)

FIGS. 6A and 6B show the sensitometric behavior of the coatings of Examples 7, 8 and 9, and Table III tabulates the determined red, green and blue sensitometric behavior of these examples. It is seen in FIG. 6A (dashed line), that the prior art compound Pluronic L44 (PA-1) caused sensitometry to vary widely from the control, especially the red sensitometry. The fast cyan layer (or the red layer) contains this additive. This conclusion is also evident from the tabulated sensitometric results, of Table III. However, the results of Example 9, using a viscosity reducing agent of this invention shows sensitometry virtually identical, within experimental limits, to the control coating (see FIG. 6B and Table III). This demonstrates the advantage of use of the compounds of the present invention over those of prior art listed in Table I. This prior art material in photographic systems produced adverse sensitometric effects. However, they are effective viscosity control agents in their own right. Therefore, it is probably feasible to use such material in mixture with surfactants of this invention but in much lesser quantities to achieve this objective of this invention without significant adverse photographic effect. The amount of such prior art viscosity reducing agent, a polyol compound having a molecular weight of from about 1,100 to about 27,000, in the melt could be between 1 and 5 times the weight of the water soluble photographic agent, with large hydrophobic groups.

TABLE III

Sensitometric Behaviors of Multilayer Coatings of Examples 7, 8, and 9

| Example | Record | Dmax | Dmin | Relative Speed | Low | Gradiant* Low-Mid | Gradiant* Upper-Mid |
|---|---|---|---|---|---|---|---|
| 7 Control | Red | 1.860 | 0.188 | 319 | 0.492 | 0.550 | 0.598 |
| | Green | 2.680 | 0.529 | 322 | 0.696 | 0.628 | 0.686 |
| | Blue | 2.940 | 0.704 | 323 | 0.670 | 0.623 | 0.817 |
| 8 Prior Art | Red | 1.280 | 0.170 | 320 | 0.455 | 0.402 | 0.290 |
| | Green | 2.490 | 0.499 | 322 | 0.697 | 0.614 | 0.604 |
| | Blue | 3.060 | 0.687 | 325 | 0.674 | 0.699 | 0.653 |
| 9 Invention | Red | 1.880 | 0.190 | 319 | 0.461 | 0.538 | 0.596 |
| | Green | 2.800 | 0.506 | 321 | 0.649 | 0.646 | 0.716 |
| | Blue | 2.940 | 0.697 | 323 | 0.674 | 0.634 | 0.777 |

Gradiant Definitions:
Low: Gradiant of the line between Dmin +0.15 and 0.4 log E higher exposure point.
Low-Mid: Gradiant of the line between Dmin +0.15 + 0.4 log E higher exposure point and 1.1 log E further exposure point and 1.1 log E further higher exposure point.
Upper-Mid: Gradiant of the line between Dmin +0.15 + 1.1 log E higher exposure point and further 1.8 log E higher exposure point.

EXAMPLE 10 THROUGH 14: VISCOSITY CONTROL OF GELATIN MELTS CONTAINING OXIDIZED DEVELOPER SCAVENGER (SC-1)

The sulfonated oxidized developer scavenger (SC-1) as indicated earlier, is also one of the soluble compounds that when admixed in gelatin melts produce high viscosity. Table IV shows viscosity values of gelatin melts containing SC-1. Example 10 is a melt that has no SC-1, and shows a viscosity of 15.0 CP (mP*s). Incorporation of 0.26% (SC-1) in the melt raises the viscosity to 46.0 CP (mP*s). However, it is seen that the compound APG 225 (SA-9) to the melt reduces the viscosity of the melts (Example 12, 13 and 14) progressively, to virtually the value of that of the melt that has no (SC-1). It is seen that beyond 0.75% of APG 225 (SA-9), the viscosity reducing effect is of diminishing return. Based on the results of Table II and Table IV, it is seen that the range of this invention compound needed is between 3 to 6 times the weight of the soluble photographic agent that causes high viscosity. It is to be noted that oxidized developer scavenger is usually used at very low levels. Therefore, the amount of the viscosity reducing agent needed is not excessive.

Results of Table IV also prove that the compound of this invention reduces the high viscosity of melts with different types of melt viscosity enhancing photographic agents.

The invention has been described in detail with particular reference to preferred embodiments thereof, but it will be understood that variations and modifications can be effected within the spirit and scope of the invention.

TABLE IV

Viscosity of Gelatin Melt Using Oxidized Developer Scavenger (SC-1)

| | Gelatin % | (SC-1) % | Viscosity Reducing Agent | % Viscosity Reducing Agent | Brookfield Viscosity at 40° C. and 80/sec$^{-1}$ in CentiPoise or mP*s |
|---|---|---|---|---|---|
| 10 No (SC-1)* (Control) | 9.4 | 0 | None | 0 | 15.0 |
| 11 Control | 9.4 | 0.26 | None | 0 | 46.0 |
| 12 Control | 9.4 | 0.26 | (SA-9) | 0.75 | 22.8 |
| 13 Invention | 9.4 | 0.26 | (SA-9) APG225 | 1.50 | 18.0 |
| 14 Invention | 9.4 | 0.26 | (SA-9) APG225 | 2.25 | 16.8 |

*(SC-1) with n = 16.

We claim:

1. A melt for the coating of a layer in a photographic element comprising a solution of water, gelatin and in solution an anionically charged, hydrophobic group containing compound that is water soluble or soluble in a solution of 5 to 20 percent of water miscible organic solvent, said melt being further characterized by containing an amount of an amphiphilic compound which is sufficient to reduce the viscosity of said melt, said compound selected from the class consisting of:

Type A: Sugar (saccharidic) compounds, characterized by having one to three hydrophobic groups, each group containing from about 6 to about 22 carbon atoms, and having one or more attached hydrophilic mono- or oligosaccharidic hydrophilic chains; and Type B: Compounds comprising a hydrophobic group having from about 6 to about 22 carbon atoms and having one or two attached hydrophilic chains comprising at least 4 oxyethylene and/or glycidyl ether groups and mixtures thereof.

2. The melt of claim 1 wherein said anionically charged, hydrophobic group containing compound is a group selected from the following groups $-SO_3^-$, $-SO_4^-$, and $-COO^-$.

3. The melt of claim 2 having a composition comprising:

(a) gelatin, 3–20 weight percent, (b) silver halide emulsion, 0–50 weight percent, (c) coupler dispersion, 0–40 weight percent, (d) said anionic charged hydrophobic group containing compound, 0.1–10 weight percent;

(e) from about 1 to about 10 times by weight of component (d) of said amphiphilic compound.

4. The melt of claim 3 wherein component (e) is a compound of Type (A).

5. The melt of claim 3 wherein component (e) is a compound of Type (B).

6. The melt of claim 4 additionally containing, in an amount of from about 1 times to about 5 times the weight of component (d), a polyol compound having a molecular weight of from about 1,100 to about 27,000.

7. The melt of claim 3 wherein component (e) is selected from at least one of the following Type (A) compounds:

SA-1

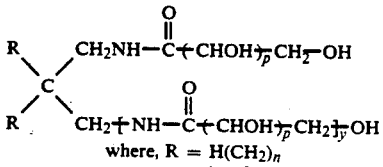

where, R = $H(CH_2)_n$
n = 4 to 8 or

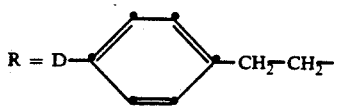

p = 3 to 10
D = $(CH_2)_z$
y = 0 or 1
z = 0–10

SA-2

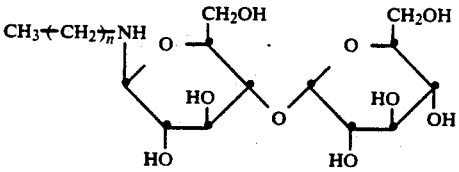

where, n = 3 to 15

SA-3

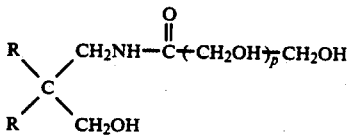

where, R = n-$CH_3(CH_2)_x$ (where x = 3 to 7), or

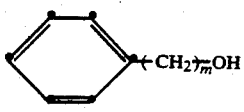

p = 3 to 15
m = 2 to 5

-continued

SA-4

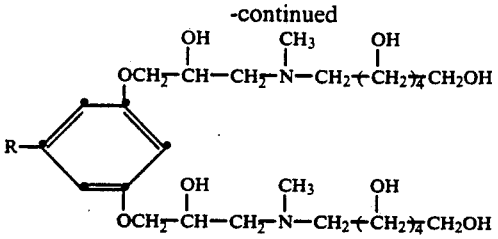

where, R = n-$CH_3(CH_2)_x$
(where, x = 5 to 14)

SA-5

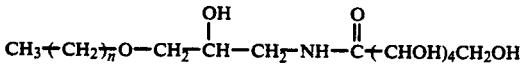

where, n = 3 to 15

SA-6

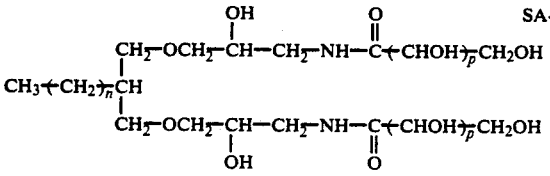

where, n = 2 to 12
p = 3 to 10

SA-7

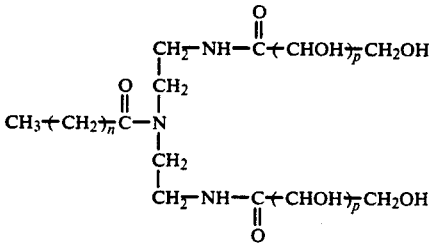

where, n = 6 to 18
p = 3 to 10

SA-8

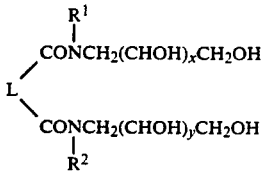

wherein

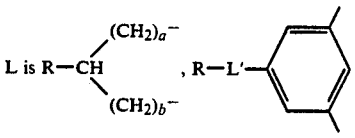

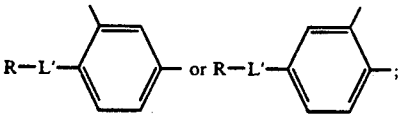

L' is a chemical bond, —O—, 'S—, —NH—, —CONH— or —$SO_2$NH—;

R is a hydrophobic substituted or unsubstituted alkyl, or a substituted or unsubstituted coalkyl, or a substituted or unsubstituted aryl group containing 8 to 20 carbon atoms;

each $R^1$ and $R^2$ independently is hydrogen or an alkyl group having form 1 to 4 carbon atoms;

each of a and b independently is 0 or an integer from 1 to 3, provided that the sum of a and b is not greater than 3; and, each of x and y independently is an integer from 3 to 7:

Alkyl Polyglycosides

SA-9

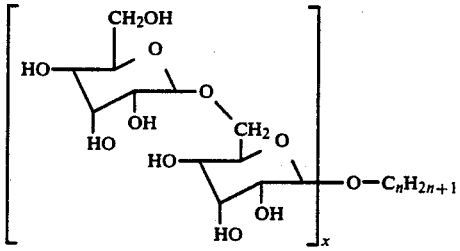

wherein when n is 8 and 10, x = 1.8, when
n is 9, 10 and 11, x = 1.4, when
n is 9, 10 and 11, x = 1.6, when
n is 12 and 14, x = 1.4, and when
n is 12 and 14, x = 1.6

Sucrose Alkyl Esters

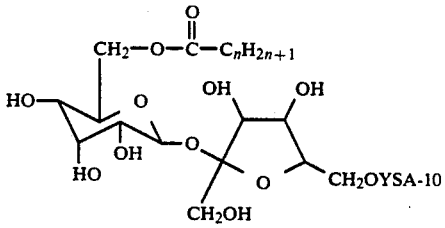

where n = 9 to 17, Y = —H or, —C(=O)—$C_nH_{2n+1}$

Sucrose Alkyl Amide and Ether

SA-11

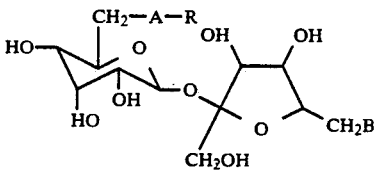

where R = —$C_{10}H_{21}$ to —$C_{18}H_{37}$ and —A— is —O—C(=O)—NH— or —O— and B is —OH or —A—R.

8. The melt of claim 3 wherein component (e) comprises at least one of the following B compounds

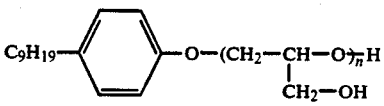

n = 5-12 (mixture)

n-$C_{12}H_{25}$—O—($CH_2$—$CH_2$—O)$_{12}$—$SO_3^-Na^+$

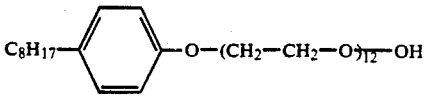

-continued $$n\text{-}C_{12}H_{25}-O-(CH_2-CH_2-O)_{23}-OH$$

$$C_{10}H_{21}-O-(CH_2-CH_2-O)_{15}-CH_2-Na^+SO_3^-$$

9. The melt of claim 6 wherein said polyol compound comprises at least one of the following

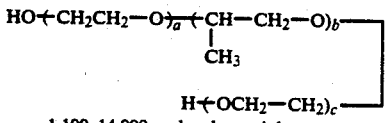

PA-1

1,100–14,000 molecular weight range a = 1–128, b = 16–69, and c = 1–128

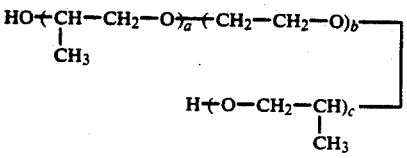

PA-2

-continued 1,900–9,000 molecular weight range a = 8–268, b = 43–204, and c = 8–268

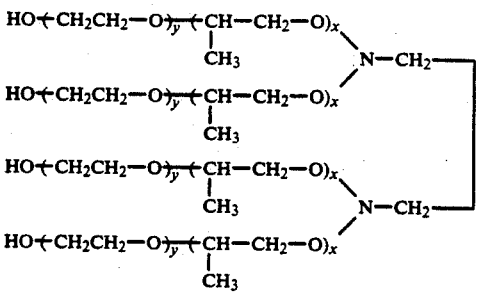

PA-4

3,200–27,000 molecular weight range x = 2–31
y = 7–491.

10. The melt of claim 3 wherein component (d) comprises at least one of the following masking couplers:

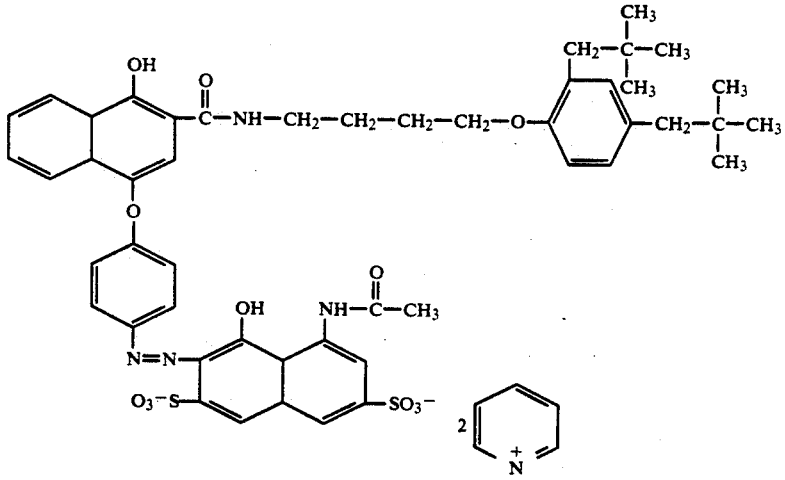

(M-1)

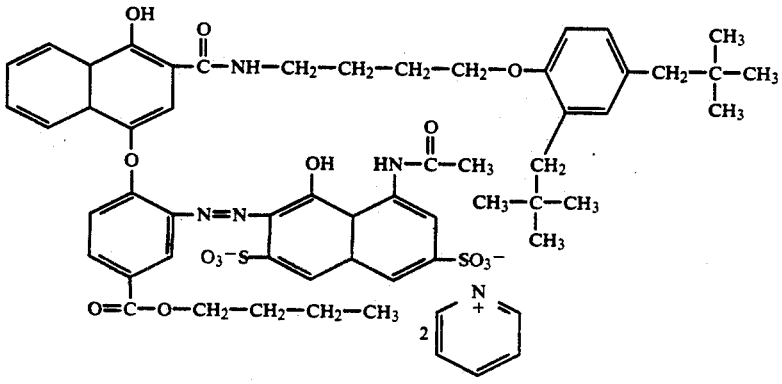

(M-2)

-continued
(M-3)
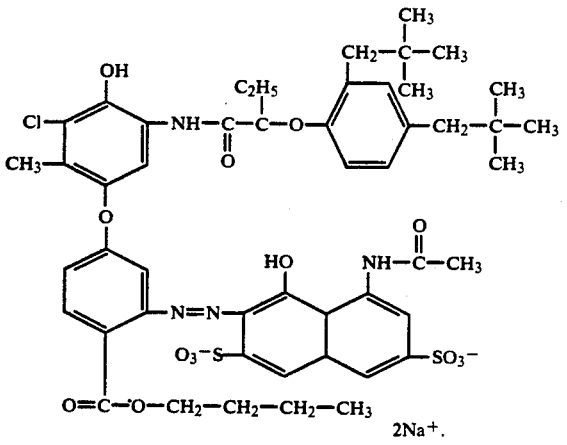
11. The melt of claim 3 wherein component (d) of claim 3 comprises at least one of the following oxidized developer scavengers:
(SC-1)
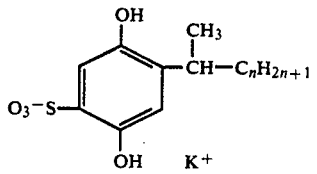
(SC-2)
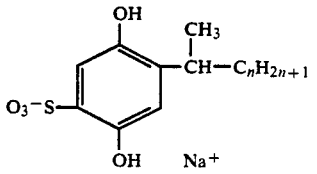
where n is between 10 and 18.
12. The melt of claim 3 wherein component (d) comprises
(UV-1)
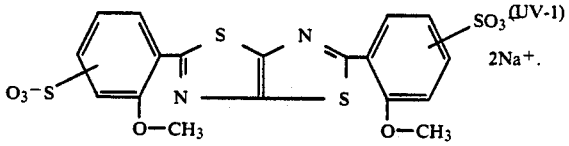
13. The melt of claim 1 wherein component (d) comprises at least one of the following optical brighteners:
(OB-1)
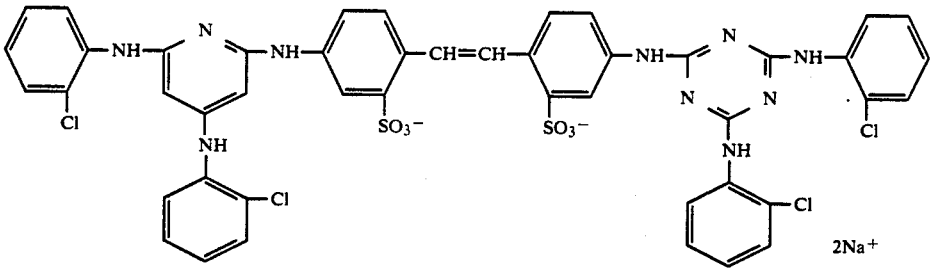
(OB-2)
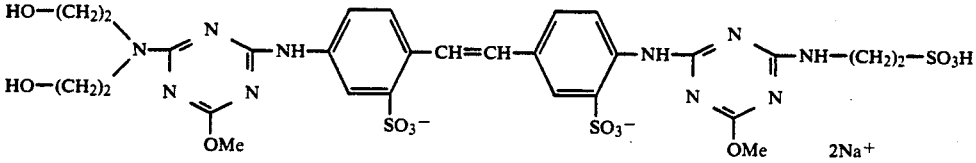
(OB-3)
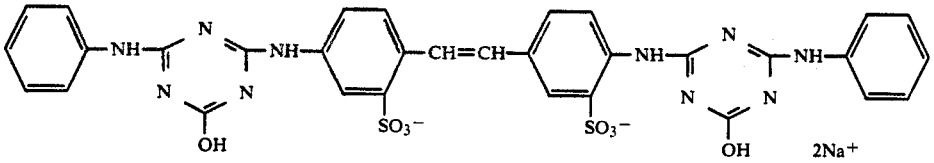

-continued
(OB-4)
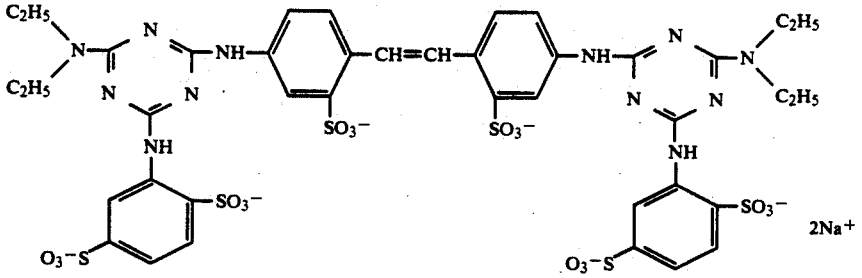
(OB-5)
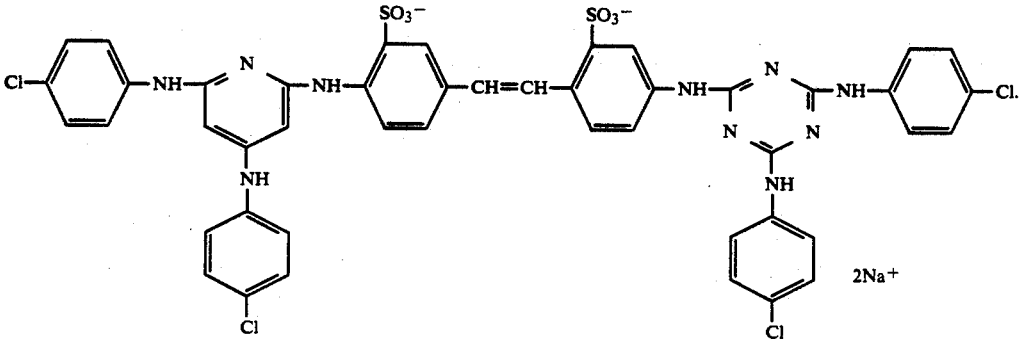
14. The melt of claim 3 wherein component (d) comprises at least one of the following bleachable dyes:
(DTD-1)
(BD-1)
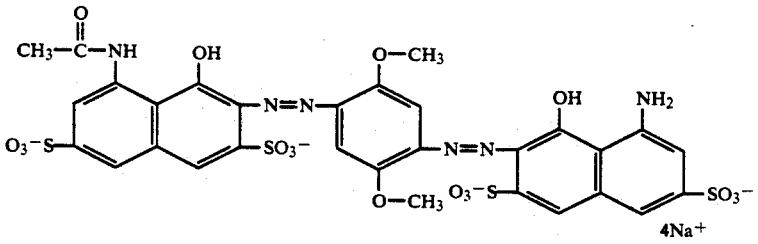
(BD-2)
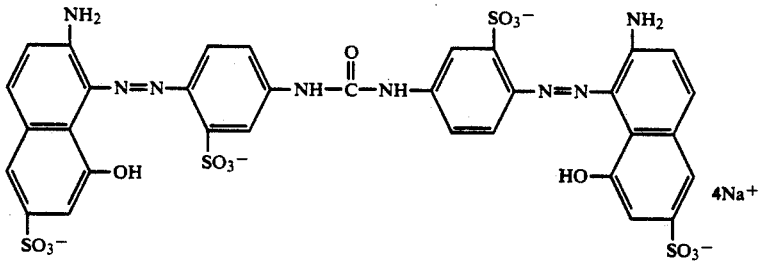
(BD-3)
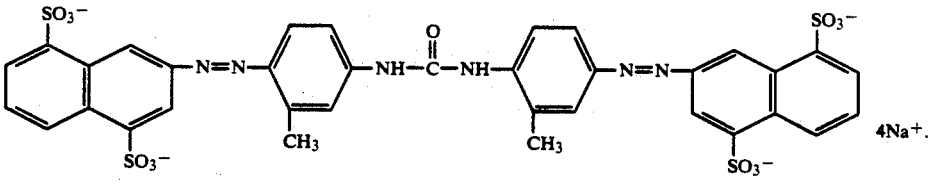
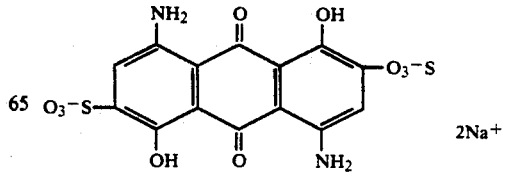
15. The melt of claim 3 wherein component (d) comprises at least one of the following dye transfer dyes:

-continued (DTD-2)

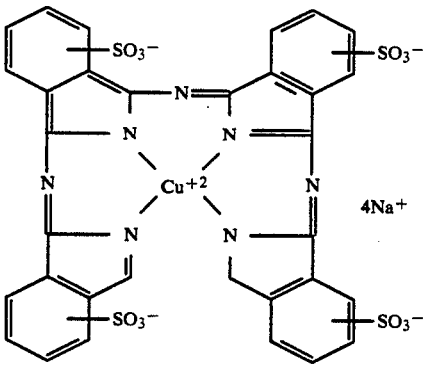

-continued (DTD-4)

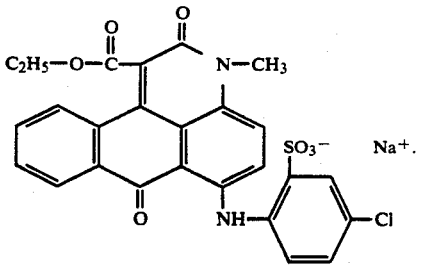

16. The melt of claim 1 wherein component (d) comprises at least one of the following dyes:

(D-1)

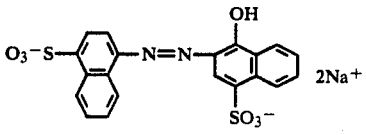

(D-2)

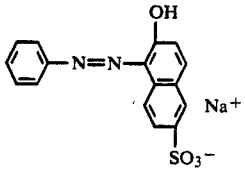

(D-3)

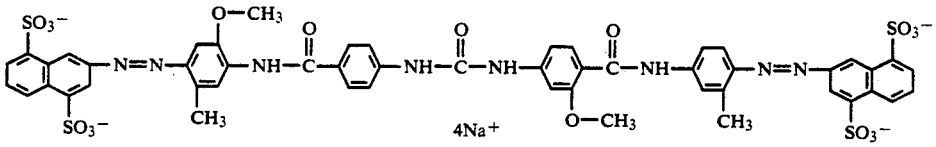

(D-4)

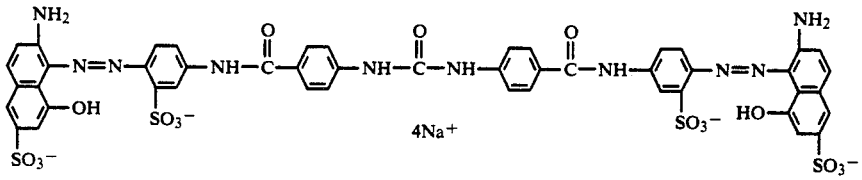

(D-5)

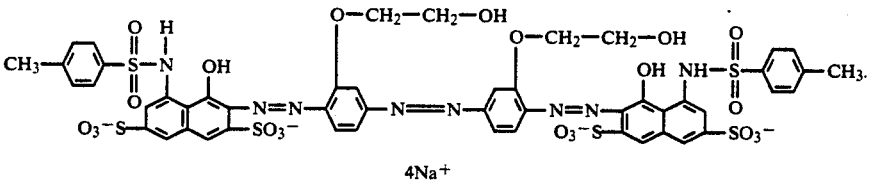

(DTD-3)

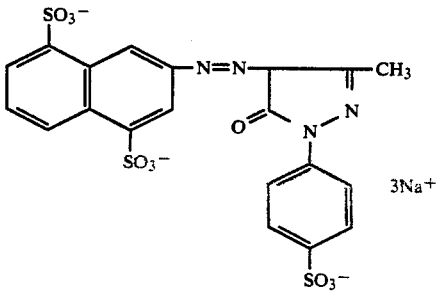

17. The melt of claim 1 said layer comprises a layer in a multilayer color negative photographic element.

18. The melt of claim 1 wherein said layer comprises a layer in a multilayer color paper element.

19. The melt of claim 1 wherein said layer comprises a layer in a multilayer photographic temporary element.

20. The melt of claim 1 wherein said layer comprises a layer in a multicolor dye transfer color photographic element.

21. The melt of claim 1 wherein said layer comprises a layer in a black and white photographic element.

22. The method of claim 14 wherein component (e) comprises at least one of the following B compounds

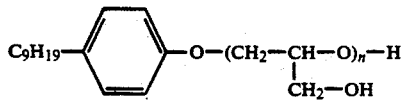

n = 5-12 (mixture)

$n\text{-}C_{12}H_{25}—O—(CH_2—CH_2—O)_{12}—SO_3^-Na^+$

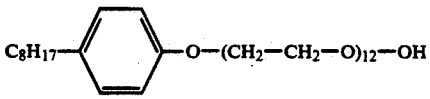

$n\text{-}C_{12}H_{25}—O—(CH_2—CH_2—O)_{23}—OH$ $C_{10}H_{21}—O—(CH_2—CH_2—O)_{15}—CH_2$
$Na^+SO_3^-—CH_2.$

23. A method of forming a layer of a photographic element comprising forming a melt by mixing materials to form a solution comprising water, gelatin and an anionically charged, hydrophobic group containing compound that is (a) water soluble or soluble in a solution of 5 to 20 percent of water miscible organic solvent, said melt being further characterized by containing an amount of an amphiphilic compound which is sufficient to reduce the viscosity of said melt, said compound selected from the class consisting of:

Type A: Sugar (saccharidic) compounds, characterized by having one to three hydrophobic groups, each group containing from about 6 to about 22 carbon atoms, and having one or more attached hydrophilic mono- or oligosaccharidic hydrophilic chains; and Type B: Compounds comprising a hydrophobic group having from about 6 to about 22 carbon atoms and having one or two attached hydrophilic chains comprising at least 4 oxyethylene and/or glycidyl ether groups and mixtures thereof and casing said melt as a layer of a photographic element.

24. The method of claim 23 wherein said anionically charged, hydrophobic group containing compound is a group selected from the following groups $-SO_3^-$, $-SO_4^-$, and $-COO^-$.

25. The method of claim 24 having a composition comprising:

(a) gelatin, 3-20 weight percent,
(b) silver halide emulsion, 0-50 weight percent,
(c) coupler dispersion, 0-40 weight percent,
(d) said anionically charged hydrophobic group containing compound, 0.1-10 weight percent;
(e) from about 1 to about 10 times by weight of component (d) of said amphiphilic compounds.

26. The method of claim 25 wherein component (e) is a compound of Type (A).

27. The method of claim 25 wherein component (e) is a compound of Type (B).

28. The method of claim 26 additionally containing from about 1 times to about 5 times the weight of component (d), of a polyol compound having a molecular weight of from about 1,100 to about 27,000.

29. The method of claim 25 wherein component (e) comprises at least one of the following Type (A) compounds

SA-1

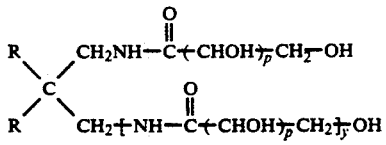

where, R = $H(CH_2)_n$
n = 4 to 8 or

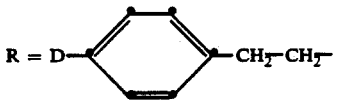

p = 3 to 10
D = $(CH_2)_z$
y = 0 or 1
z = 0-10

SA-2

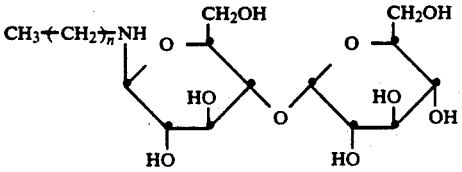

where, n = 3 to 15

SA-3

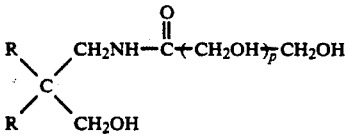

where, R = $n\text{-}CH_3(CH_2)_x$ (where x = 3 to 7)

or

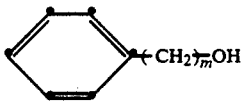

p = 3 to 15
m = 2 to 5

SA-4

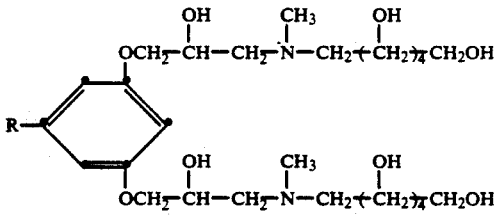

where, R = $n\text{-}CH_3(CH_2)_x$
(where, x = 5 to 14)

SA-5

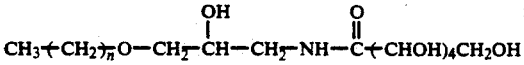

where, n = 3 to 15

SA-6

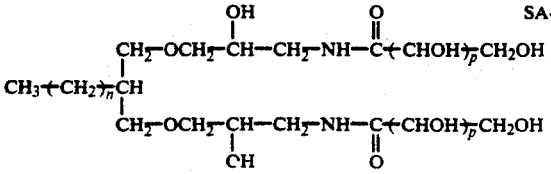

where, n = 2 to 12
p = 3 to 10

-continued

SA-7

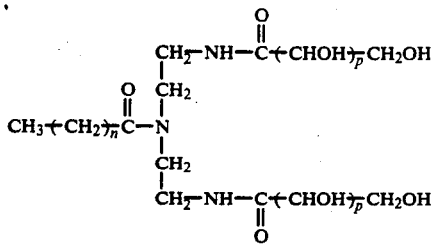

where, n = 6 to 18
p = 3 to 10

SA-8

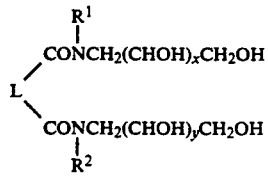

wherein

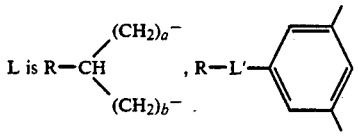

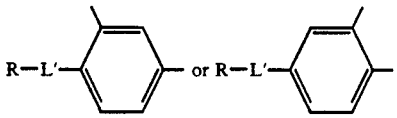

L' is a chemical bond, —O—, —S—, —NH—, —CONH— or —$SO_2NH$—;

R is a hydrophobic substituted or unsubstituted alkyl, or a substituted or unsubstituted coalkyl, or a substituted or unsubstituted aryl group containing 8 to 20 carbon atoms;

each $R^1$ and $R^2$ independently is hydrogen or an alkyl group having form 1 to 4 carbon atoms;

each of a and b independently is 0 or an integer from 1 to 3, provided that the sum of a and b is not greater than 3; and, each of x and y independently is an integer from 3 to 7:

Alkyl Polyglycosides

SA-9

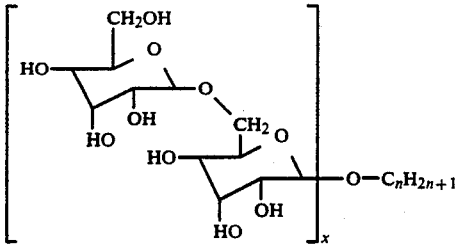

wherein when n is 8 and 10, x = 1.8, when
n is 9, 10 and 11, x = 1.4, when
n is 9, 10 and 11, x = 1.6, when
n is 12 and 14, x = 1.4, and when
n is 12 and 14, x = 1.6

Surcrose Alkyl Esters

SA-10

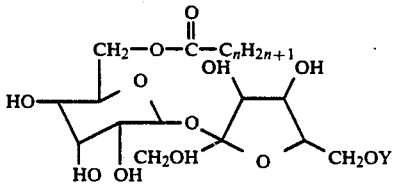

where n = 9 to 17,

Y = —H or, —C(=O)—$C_nH_{2n+1}$

Sucrose Alkyl Amide and Ester

SA-11

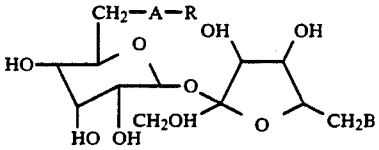

where R = —$C_{10}H_{21}$ to —$C_{18}H_{37}$ and —A— is —O—C(=O)—NH or —O— and B is —OH or —A—R.

* * * * *

IN THE UNITED STATES PATENT AND TRADEMARK OFFICE

CERTIFICATE OF CORRECTION

PATENT NO. : 5,300,418

DATED : April 5, 1994

INVENTOR(S) : G. W. Visconte et al.

It is certified that errors appear in the above-identified patent and that said Letters Patent is hereby corrected as shown below:

Col 31, line 60, delete "'S—" and insert --- —S— ---.

Col 41, line 42, delete "casing" and insert --- casting ---.

Signed and Sealed this

Twentieth Day of September, 1994

*Attest:*

Bruce Lehman

BRUCE LEHMAN

*Attesting Officer*

*Commissioner of Patents and Trademarks*